United States Patent [19]

Ueda et al.

[11] Patent Number: 4,818,673

[45] Date of Patent: Apr. 4, 1989

[54] METHOD FOR PROCESSING A SILVER HALIDE COLOR PHOTOGRAPHIC MATERIAL

[75] Inventors: Shinji Ueda; Kazunori Hasebe; Junya Nakajima, all of Kanagawa, Japan

[73] Assignee: Fuji Photo Film Co., Ltd., Kanagawa, Japan

[21] Appl. No.: 82,003

[22] Filed: Aug. 5, 1987

[30] Foreign Application Priority Data

Aug. 5, 1986 [JP] Japan ..... 61-183944

[51] Int. Cl.[4] ..... G03C 7/02; G03C 5/44; G03C 5/24; G03C 7/32

[52] U.S. Cl. ..... 430/566; 430/393; 430/430; 430/435; 430/484; 430/491; 430/502; 430/503; 430/552; 430/553; 430/554; 430/555; 430/556; 430/557; 430/558

[58] Field of Search ..... 430/393, 502, 503, 430, 430/552–558, 491, 489, 435, 566

[56] References Cited

U.S. PATENT DOCUMENTS

| | | | |
|---|---|---|---|
| T910,002 | 5/1973 | Hotter | 430/393 |
| 3,706,561 | 12/1972 | Mowrey et al. | 430/376 |
| 3,893,858 | 7/1975 | Wabnitz, Jr. | 430/430 |
| 4,452,882 | 6/1984 | Akimura et al. | 430/441 |
| 4,585,733 | 4/1986 | Ezaki et al. | 430/569 |
| 4,695,529 | 9/1987 | Abe et al. | 430/393 |

FOREIGN PATENT DOCUMENTS

| | | |
|---|---|---|
| 0048545 | 4/1979 | Japan . |
| 0926569 | 5/1963 | United Kingdom . |
| 0990846 | 5/1965 | United Kingdom . |
| 1495231 | 12/1977 | United Kingdom . |

*Primary Examiner*—Mukund J. Shah

*Attorney, Agent, or Firm*—Sughrue, Mion, Zinn, Macpeak & Seas

[57] ABSTRACT

A method for processing a silver halide color photographic material is disclosed, which comprises processing an imagewise exposed silver halide color photographic material comprising a support having thereon at least one silver halide emulsion layer comprising silver chloride or silver chlorobromide containing at least 80 mol % of silver chloride with a color developing solution and thereafter processing the material with a bleach-fixing solution, wherein the bleach-fixing solution contains a ferric complex salt of an organic acid and from about $1\times10^{-2}$ to about 2 mol of bromide ions and/or from about $5\times10^{-4}$ to about $5\times10^{-2}$ mol of iodide ions per liter.

The method for processing a silver halide color photographic material according to the present invention is excellent in desilvering ability, and enables rapid processing to be conducted.

17 Claims, No Drawings

METHOD FOR PROCESSING A SILVER HALIDE COLOR PHOTOGRAPHIC MATERIAL

FIELD OF THE INVENTION

The present invention relates to a method for processing a silver halide color photographic material, and more particularly, to a method for processing a silver halide color photograhic material which is capable of rapidly processing a silver halide color photographic material containing silver chloride or silver chlorobromide having a high silver chloride content.

BACKGROUND OF THE INVENTION

Methods for processing silver halide color photographic materials (hereinafter referred to as color light-sensitive materials) generally comprise a color development step to form color images, a desilvering step to remove developed silver and undeveloped silver halide, and a water washing step and/or an image stabilizing step.

Heretofore, attempts have been made to reduce the processing time necessary for processing color light-sensitive materials. Recently, however, further reduction of the required processing time has been highly desirable in terms of reducing the total time period needed to finish processing, simplification of laboratory work, and miniaturization and simple operation of the processing system for small scale laboratories known as mini-labs, etc.

A method in which the time required to perform the color development step is reduced is known, and comprises processing a color light-sensitive material containing silver chloride or silver chlorobromide having a high silver chloride content. The color development speed of color light-sensitive materials containing silver chloride or silver chlorobromide having a high silver chloride content is extremely high as compared with, e.g., the color development speed of color light-sensitive materials containing silver chlorobromide having a high silver bromide contents, silver bromide, or silver iodobromide as employed in conventional color papers, etc. Therefore, the potential exists at present for reduction of developing time to a large extent.

Further, the color light-sensitive materials containing silver chloride or silver chlorobromide having a high silver chloride content is preferred since halogen ions released in a processing solution upon development are mainly or wholly chloride ions. On the contrary, halogen ions released are mainly or wholly bromide ions when color developing the other types of color light-sensitive materials referred to above. The chloride ions are characterized in that they have a remarkably small development inhibiting effect in comparison with bromide ions, and thus do not decrease the color development activity of the color developing solution even when accumulate therein in high concentrations. As a result, the amount of replenishing solution for the color developing solution can be reduced in the case of processing the color light-sensitive materials containing silver chloride or silver chlorobromide having a high silver chloride content using an automatic developing machine, as compared with color developing conventional color light-sensitive materials containing mainly silver bromide.

Hitherto, the desilvering step in the processing of color light-sensitive materials has been conducted by two different types of systems. One is a processing system wherein a bleaching step (by which developed silver is oxidized) and a fixing step (by which undeveloped silver halide and silver halide formed in the bleaching step are solubilized using a silver halide solvent) are carried out separately; the other is a processing system wherein the bleaching step and the fixing step are carried out at the same time in a single bath, that is, a so-called bleach-fixing system. Of these systems, the bleach-fixing system has the advantage of using only one processing solution, which is effective for purposes of miniaturization and simplification of the processing system, and thus, is practically employed in the processing of color light-sensitive materials such as color paper, color reversal paper, etc.

While various compounds have been proposed to be added to the bleach-fixing bath, a bleach-fixing solution containing a ferric complex salt of aminopolycarboxylic acid as a bleaching agent and a thiosulfate as a fixing agent is usually employed in practice, at present.

However, ferric complex salts of aminopolycarboxylic acids, such as a ferric complex salt of ethylenediaminetetraacetic acid, have a comparatively small oxidizing power and therefore, have insufficient bleaching power, although they are advantageous as to prevention of environmental pollution because of their low toxic character. As a result, color light-sensitive materials to which such a bleach-fixing system can be applied are limited to those having a low coating amount of silver.

With respect to methods for accelerating such a bleach-fixing step, a small number of techniques are known and only restricted number of accelerators have been investigated. For instance, compounds having a mercapto group or a disulfide group as described in U.S. Pat. No. 3,893,858, West German Pat. No. 1,290,812, etc., thiourea derivatives as described in U.S. Pat. No. 3,706,561, Japanese Patent Application (OPI) No. 32735/78, etc. (the term "OPI" as used herein means an "unexamined published application"), polyethyleneoxides as described in West German Pat. No. 2,748,430, etc., are exemplified. However, when these compounds having a mercapto group or a disulfide group, or the thiourea derivatives are employed as bleach-fixing accelerators for silver halide color photographic materials containing silver chloride or silver chlorobromide and having a low coating amount of silver, they tend to hinder the bleach-fixing reaction, and thus do not provide preferred results. Also, in the case of using polyethyleneoxides, sufficient effects are not obtained.

In British Pat. No. 990,846, a method in which an intermediate bath containing an iodide salt is provided between a color developing bath and a bleach-fixing bath in the overall processing sequence described. However, providing such an intermediate bath is not a preferred processing method in view of the recent trend aiming at simplification and miniaturization of the overall processing system. Further, a method of processing using a bleach-fixing solution containing an iodide salt is described in British Pat. No. 926,569. This method is effective in restrainig the hindrance of the bleach-fixing reaction during bleach-fixing processing of color light-sensitive material containing silver chlorobromide wide a low coating amount of silver and hydrophilic and diffusion-resistant couplers. However, addition of the iodide salt to the bleach-fixing solution rather adversely affects on the bleach-fixing reaction of color light-sensitive materials containing silver chlorobromide having a high silver bromide content and oil-protected type couplers which are generally used in practice at present, and preferred results can not be obtained.

Moreover, in Japanese Patent Publication No. 11854/78 and Japanese Patent Application (OPI) No. 87036/76, a method of processing color light-sensitive materials containing silver chlorobromide or silver iodobromide having a high silver bromide content in the presence of a halide salt or ammonium bromide is described. However, in this method, a small amount of silver or silver salt can not be removed and remains in the photographic materials, particularly when color light-sensitive materials containing silver chlorobromide having a high silver chloride content with a low coating amount of silver (such as color paper) are subjected to bleach-fixing processing. Such a small amount of remaining silver is particularly present at image portions having high density, and deteriorates color reproduction of the color images. This tendency is especially remarkable in yellow and red images.

The amount of remaining silver in high density portions is larger when color light-sensitive materials containing silver chloride or silver chlorobromide having a high silver chloride content as described above are subjected to bleach-fixing processing after color development processing in comparison with the case wherein conventional color light-sensitive materials containing silver chlorobromide having a high silver bromide content are processed in the same manner as above.

SUMMARY OF THE INVENTION

Therefore, an object of the present invention is to provide a rapid method for processing a color light-sensitive material.

Another object of the present invention is to provide a method for processing a color light-sensitive material, which is excellent in desilvering ability and by which resulting images having a small remaining amount of silver are obtained.

A further object of the present invention is to provide a method for processing a color light-sensitive material, which provides excellent color reproducibility.

These and other objects of the present invention will become apparent from the following description and examples.

That is, these objects of the present invention can be attained by a method for processing a silver halide color photographic material comprising processing an imagewise exposed silver halide color photographic material comprising a support having thereon at least one silver halide emulsion layer comprising silver chloride or silver chlorobromide containing at least about 80 mol% of silver chloride with a color developing solution and thereafter processing the material with a bleach-fixing solution, wherein the bleach-fixing solution contains a ferric complex salt of an organic acid and from about $1\times10^{-2}$ to about 2 mol of bromide ions and/or from about $5\times10^{-4}$ to about $5\times10^{-2}$ mol of iodide ions per liter.

DETAILED DESCRIPTION OF THE INVENTION

In the method for processing a silver halide color photographic material according to the present invention, the color developing solution preferably contains substantially no benzyl alcohol.

The term "color developing solution containing substantially no benzyl alcohol" as used herein specifically refers to a color developing solution containing benzyl alcohol in a concentration of not more than about 1 g, preferably from 0 to 0.5 g per liter of the solution.

It has been determined that the amount of remaining silver is remarkably small when a color light-sensitive material containing silver chloride or silver chlorobromide having a high silver chloride content is subjected to a bleach-fixing processing in the presence of bromide ions and/or iodide ions according to the present invention, in comparison with the case wherein a conventional color light-sensitive material containing silver chlorobromide having a high silver bromide content is subjected to the bleach-fixing processing in accordance with the present invention, as illustrated in the examples hereinafter. This discovery is considered to be completely unexpected from conventional knowledge possessed by those skilled in the art. As a result, it is now possible to process color photographic light-sensitive materials rapidly and with good color reproducibility according to the method of the present invention.

The bromide ions or iodide ions which are used in the bleach-fixing solution according to the present invention are preferably added to the bleach-fixing solution in the form of water soluble bromide salts or iodide salts. Specific examples of useful water soluble salts include alkali metal salts, ammonium salts, alkaline earth metal salts of these ions, etc., such as ammonium bromide, sodium bromide, potassium bromide, ammonium iodide, sodium iodide, potassium iodide, etc.

Preferred results can be obtained when these ions are present in the range of from about $1\times10^{-2}$ to about 2 mol of bromide ions or in the range of from about $5\times10^{-4}$ to about $5\times10^{-2}$ mol of iodide ions per liter of the bleach-fixing solution. In particular, it is preferred that the bromide ions are in a range of from $1\times10^{-2}$ to $5\times10^{-1}$ mol per liter and the iodide ions are in a range of from $5\times10^{-4}$ to $1\times10^{-2}$ mol per liter of the solution.

When the concentration of bromide ions is less than about $1\times10^{-2}$ mol per liter of the bleach-fixing solution, no bleach-fixing accelerating effect is observed, and such low amounts are not preferred in view of reduction in the amount of remaining silver. On the other hand, when the concentration of bromide ions exceeds about 2 mol per liter of the solution, insufficient fixing may tend to occur, and such high concentrations are not preferred in view of desilvering ability of the solution.

Further, it is not preferred that the concentration of iodide ions be less than about $5\times10^{-4}$ mol per liter of the solution in view of reduction in the amount of remaining silver, the same concern as in the case of the bromide ion concentration being less than about $1\times10^{-2}$ mol per liter of the solution. On the other hand, concentrations of iodide ions exceeding about $5\times10^{-2}$ mol per liter of the solution is not preferred in view of desilvering ability of the solution, the same concern as in the case of using more than about 2 mol of the bormide ions per liter of the solution.

Moreover, when the bleach-fixing solution contains both bromide ions and iodide ions, the bromide ions are desirably present in an amount from about $1\times10^{-2}$ to about 2 mol per liter of the solution, and the iodide ions are present in an amount from about $5\times10^{-4}$ to about $5\times10^{-2}$ mol per liter of the solution.

The above-noted objects of the present invention can be achieved by the use of any of bromide ions and iodide ions, alone or in combination, and the selection of using bromide ions and/or iodide ions can be made depending on the conditions to be employed during processing.

In order to control the concentration of bromide ions and/or iodide ions within the above described ranges, they can be directly added to the bleach-fixing solution, or may be added together with a replenisher. Further, they can be partially carried over from a pre-bath.

The silver halide emulsion which can be used in the present invention comprises silver halide containing at least about 80 mol% of silver chloride and substantially no silver iodide. The content of silver chloride in the silver halide emulsion is preferably at least 90 mol%, and more preferably at least 95 mol%. A pure silver chloride emulsion can be employed, if desired. When the content of silver chloride in the emulsion is lower than about 80 mol% color development proceeds slowly, whereby it is difficult to obtain sufficiently high color density.

The term "silver halide emulsion containing substantially no silver iodide" as used in the present invention means a silver halide emulsion wherein the silver iodide content is not more than about 1 mol%, and more preferably not more than 0.5 mol%. Most preferably, the silver halide emulsion does not contain silver iodide at all. Silver iodide is not preferred in the emulsion due to retardation in development speed and increase in fog formation in some cases.

The amount of silver halide coated on a reflective support (calculated in terms of silver) is preferably not more than about 0.78 g/m$^2$. When the amount of the silver halide coated is too great, color development again proceeds slowly, whereby it is difficult to obtain sufficiently high color density.

The average grain size of silver halide grains in the silver halide emulsion used in the present invention (the grain size being defined as grain diameter if the grains are spherical, wherein the average is based on projected areas of the grains) is preferably from about 0.1 μm to about 2 μm, and more preferably from 0.2 μm to 1.3 μm. Further, it is preferred to employ a monodispersed silver halide emulsion. The grain size distribution, representing the degree of monodispersibility, is preferably not more than about 0.2, and more preferably not more than 0.15 in terms of a ratio ($s/\bar{d}$) of a statistical standard deviation(s) to an average grain size ($\bar{d}$).

Silver halide grains which can be used in the present invention may have different layers in the inner portion and the surface portion, multi-phase structures containing junctions, or may be uniform throughout the grains. Further, a mixture of these silver halide grains having different structures may be employed.

Silver halide grains which can be used in the present invention may have a regular crystal structure, for example, a cubic, octahedral, dodecahedral or tetradecahedral structure, etc., an irregular crystal structure, for example, a spherical structure, etc., or a composite structure thereof. Further, tabular silver halide grains can be used. Particularly, a silver halide emulsion can be employed wherein tabular silver halide grains having a ratio of diameter/thickness of not less than about 5, and preferably not less than 8, account for at least about 50% of the total projected area of the silver halide grains present. In addition, mixtures of silver halide grains having different crystal structures may be used.

The above-described silver halide emulsions may be of the surface latent image type, in which latent images are formed mainly on the surface thereof, and of the internal latent image type, in which latent images are formed mainly in the interior thereof.

Photographic emulsions as used in the present invention can be prepared in any suitable manner, for example, by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964), etc. That is, any of an acid process, a neutral process, an ammonia process, etc., can be employed.

Soluble silver salts and soluble halogen salts can be reacted by techniques such as a single jet process, a double jet process, or a combination thereof. In addition, a method (a so-called reversal mixing process) in which silver halide grains are formed in the presence of an excess of silver ions can be employed. As one type of double jet process, a so-called controlled double jet process in which the pAg in a liquid phase where silver halide is formed is maintained at a pre-determined level, can be employed. This process can result in a silver halide emulsion in which the crystal form is regular and the particle size is nearly uniform.

Further, a silver halide emulsion which is prepared by a so-called conversion method employing a process in which a silver halide previously formed is converted to a silver halide having a lower solubility product before the completion of formation of silver halide grains, or in which a silver halide emulsion which is subjected to similar halogen conversion after the completion of formation of silver halide grains, may also be employed.

During the step of formation or physical ripening of silver halide grains, cadmium salts, zinc salts, lead salts, thallium salts, iridium salts or complex salts thereof, rhodium salts or complex salts thereof, iron salts or complex salts thereof, etc. may be present.

After the formation of silver halide grains, silver halide emulsions are usually subjected to physical ripening, removal of soluble salts and chemical ripening prior to coating.

Known silver halide solvents (for example, ammonia, potassium thiocyanate, and the thioethers and thione compounds a described in U.S. Pat. No. 3,271,157, Japanese Patent Application (OPI) No. 12360/76, 82408/78, 144319/78, 100717/79 and 155828/79, etc.) can be employed during the steps of formation, physical ripening or chemical ripening of the silver halide.

For removal of soluble silver salts from the emulsion after physical ripening, a noodle washing process, a flocculation process or an ultrafiltration process, etc. can be employed.

The silver halide emulsion which can be used in the present invention may be sensitized by, e.g., a sulfur sensitization method using active gelatin or compounds containing sulfur capable of reacting with silver (for example, thiosulfates, thioureas, mercapto compounds and rhodanines, etc.), a reduction sensitization method using reducing substances (for example, stannous salts, amines, hydrazine derivatives, formamidinesulfinic acid and silane compounds, etc.), a noble metal sensitization method using metal compounds (for example, complex salts of Group VIII metals in the Periodic Table, such as Pt, Ir, Pd, Rh, Fe, etc., as well as gold complex salts); and so forth; these sensitization methods can be applied to the emulsion alone or in combination with each other.

Of the above-described chemical sensitization methods, sulfur sensitization alone is preferred.

Further, in order to achieve the desired gradation of the color photographic light-sensitive material, two or more monodispersed silver halide emulsions which have substantially the same spectral sensitivity but have differing grain sizes from each other can be mixed in one emulsion layer, or can be coated in the form of superimposed layers (regarding monodispersity, the coefficient of variation described above is preferred). Moreover, two or more polydispersed silver halide emulsions, or combinations of a monodispersed emulsion and a polydispersed emulsion, may be employed in admixture or in the form of superimposed layers.

Each of blue-sensitive, green-sensitive and red-sensitive emulsions used in the present invention can be spectrally sensitized with methine dyes or other dyes so as to each have color sensitivity. Suitable sensitizing dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; further, nucleui formed by condensing alicyclic hydrocarbon rings with these above-described nuclei, and nuclei formed by condensing aromatic hydrocarbon rings with these above-descubed nuclei, that is, an indolenine nucleus, a benzindolenine nucleus, an indole nucleus, a benzoxadole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain as nuclei having a keto-methylene structure, 5- or 6-membered heterocyclic nuclei such as a pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

These sensitizing dyes can be employed individually, and can also be employed in combination, if desired a combination of sensitizing dyes is often used particularly for the purpose of supersensitization. Typical examples of supersensitizing dye combinations are described in U.S. Pat. Nos. 2,688,545, 2,977,229, 3,397,060, 3,522,052, 3,527,641, 3,617,293, 3,628,964, 3,666,480, 3,762,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect, or together with materials which do not substantially absorb visible light but exhibit a supersensitizing effect.

It is preferred that couplers which are incorporated into photographic light-sensitive materials are rendered diffusion resistant by means of containing a ballast group, or by polymerization. It is also preferred that the coupling active positions of couplers are substituted with a group capable of being released (two-equivalent couplers) other than being substituted with a hydrogen atom (four-equivalent couplers) from the standpoint that the coating amount of silver may be reduced. Further, couplers which form dyes having an appropriate diffusibility, non-color forming couplers, or couplers capable of releasing development inhibitors (DIR couplers) or development accelerators accompanying the coupling reaction can be employed.

Typical yellow couplers used in the present invention include oil-protected acylacetamide type couplers. Specific examples thereof are described in U.S. Pat. Nos. 2,407,210, 2,875,057 and 3,265,506, etc. In the present invention, two-equivalent yellow couplers are preferably employed, and typical examples thereof include yellow couplers of an oxygen atom releasing type as described in U.S. Pat. Nos. 3,408,194, 3,447,928, 3,933,501 and 4,022,620, etc., and yellow couplers of a nitrogen atom releasing type as described in Japanese Patent Publication No. 10739/83, U.S. Pat. Nos. 4,401,752 and 4,326,024, *Research Disclosure,* No. 18053 (April, 1979), British Pat. No. 1,425,020, West German Patent Application (OLS) Nos. 2,219,917, 2,261,361, 2,329,587 and 2,433,812, etc. α-Pivaloylacetanilide type couplers are characterized by good fastness, particularly good light fastness, of dyes formed, and α-benzylacetanilide type couplers are characterized by providing high color density.

Magenta couplers which may be used in the present invention include oil-protected indazolone type couplers, cyanoacetyl type couplers, and preferably 5-pyrazolone type couplers and pyrazoloazole type couplers, such as pyrazolotriazoles. Of the above-noted 5-pyrazolone type couplers, those substituted with an arylamine group or an acylamino group at the 3-position thereof are preferred in view of the resulting hue and color density of the dyes formed. Typical examples thereof are described in U.S. Pat. Nos. 2,311,082, 2,343,703, 2,600,788, 2,908,573, 3,062,653, 3,152,896 and 3,936,015, etc. Suitable releasing groups for two-equivalent 5-pyrazolone type couplers include nitrogen atom releasing groups as described in U.S. Pat. No. 4,310,619, and arylthio groups as described in U.S. Pat. No. 4,351,897. Further, 5-pyrazolone type couplers having a ballast group as described in European Pat. No. 73,636 are advantageous because they provide high color density.

Examples of pyrazoloazole type couplers include pyrazolobenzimidazoles as described in U.S. Pat. No. 3,369,879, and preferably pyrazolo[5,1-c]-[1,2,4]triazoles as described in U.S. Pat. No. 3,725,067, pyrazolotetrazoles as described in *Research Disclosure,* No. 24220 (June, 1984) and pyrazolopyrazols as described in *Research Disclosure,* No. 24230 (June, 1984). Imidazo[1,2-b]pyrazoles as described in European Pat. No. 119,741 are preferred, and pyrazolo[1,5-b]-[1,2,4]triazoles as described in European Pat. No. 119,860 are particularly preferred in view of less yellow subsidiary absorption and light fastness of the dyes formed.

Suitable cyan couplers which may be used in the present invention include oil-protected naphthol type and phenol type couplers. Typical examples thereof include naphthol type couplers as described in U.S. Pat. No. 2,474,293, and preferably oxygen atom releasing type two-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers which are fast to humidity and temperature are preferably used in the present invention. Typical examples thereof include phenol type cyan couplers having an alkyl group higher than a methyl group at the metaposition of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German Patent Application (OLS) No. 3,329,729, and Japanese Patent Application No. 42671/83, etc., and phenol type couplers having a phenylureido group at the 2-position thereof and an acylamino group at the 5-position thereof as described in U.S. Pat. Nos. 3,446,622, 4,333,999, 4,451,559 and 4,427,767, etc.

Further, couplers capable of forming appropriately diffusible dyes can be used together with the above-described dyes in order to improve graininess. Specific examples of such diffusible dye types of magenta couplers are described in U.S. Pat. No. 4,366,237 and British Pat. No. 2,125,570, etc. and those of yellow, magenta and cyan couplers are described in European Pat. No. 96,570 and West German Patent Application (OLS) No. 3,234,533, etc.

These dye forming couplers and special couplers described above may be used in the form of polymers, including dimers or higher polymers. Typical examples of dye forming polymer couplers are described in U.S. Pat. Nos. 3,451,820 and 4,080,211, etc. Specific examples of magneta polymer couplers are described in British Pat. No. 2,102,173 and U.S. Pat. No. 4,367,282, etc.

Two or more kinds of these various couplers which can be used in the present invention can be incorporated together into the same layer for the purpose of satisfying the properties required of the color photographic light-sensitive materials, or the same compound can be incorporated into two or more different layers, as desired.

Couplers which can be used in the present invention may be introduced into the color photographic light-sensitive material using an oil droplet-in-water type dispersing method, wherein couplers are dissolved in either an organic solvent having a high boiling point of about 175° C. or more, a so-called auxiliary solvent having a low boiling point, or a mixture thereof. Then, the solution is finely dispersed in an aqueous medium such as water or an aqueous gelatin solution, etc., in the presence of a surface active agent. Specific examples of the organic solvents having a high boiling point are described in U.S. Pat. No. 2,322,027, etc. Preparation of such a dispersion may be accompanied by phase inversion. Further, dispersions can be utilized for coating after removing or reducing the amount of the auxiliary solvent therein by distillation, noodle washing or ultrafiltration, etc., if desired.

Specific examples of the organic solvent having a high boiling point include phthalic acid esters (for example, dibutyl phthalate, dicyclohexyl phthalate, di-2-ethylhexyl phthalate, didecyl phthalate, etc.), phosphoric or phosphonic acids esters (for example, triphenyl phosphate, tricresyl phosphate, 2-ethylhexyl diphenyl phosphate, tricyclohexyl phosphate, tri-2-ethylhexyl phosphate, tridecyl phosphate, tributoxyethyl phosphate, trichlorophenyl phosphate, di-2-ethylhexyl phenyl phosphonate, etc.), benzoic acid esters (for example, 2-ethylhexyl benzoate, dodecyl benzoate, 2-ethylhexyl-p-hydroxybenzoate, etc.), amides (for example, diethyldodecanamide, N-tetradecylpyrrolidone, etc.), alcohols or phenols (for example, isostearyl alcohol, 2,4-di-tert-amylphenol, etc.), aliphatic carboxylic acid esters (for example, dioctyl azelate, glycerol tributyrate, isostearyl lactate, trioctyl citrate, etc.), aniline derivatives (for example, N,N-dibutyl-2-butoxy-5-tert-octylaniline, etc.), hydrocarbons (for example, paraffin, dodecylbenzene, diisopropylnaphthalene, etc.), etc.

Suitable auxiliary solvents include organic solvents having a boiling point of about 30° C. or more, preferably from about 50° C. to about 160° C., etc. Typical examples of such auxiliary solvents include ethyl acetate, butyl acetate, ethyl propionate, methyl ethyl ketone, cyclohexanone, 2-ethoxyethyl acetate, dimethylformamide, etc.

The processes and effects of latex dispersing methods for incorporating the couplers into the photographic material, as well as specific examples of suitable latexes to be used in this type of incorporation, are described in U.S. Pat. No. 4,199,363, West German Patent Application (OLS) Nos. 2,541,274 and 2,541,230, etc.

The color couplers are generally employed in an amount of from about 0.001 mol to about 1 mol per mol of the light-sensitive silver halide contained in a layer into which the couplers are to be incorporated. It is preferred that the amounts of yellow couplers, magenta couplers and cyan couplers employed are in ranges of from about 0.01 mol to about 0.5 mol, from about 0.003 mol to about 0.3 mol and from about 0.002 mol to about 0.3 mol per mol of the light-sensitive silver halide, respectively.

The color photographic light-sensitive material used in the present invention may contain hydroquinone derivatives, aminophenol derivatives, amines, gallic acid derivatives, catechol derivatives, ascorbic acid derivatives, non-color-forming couplers, sulfonamidophenol derivatives, etc., as color fog preventing agents or color mixing preventing agents.

Further, in the color photographic light-sensitive material used in the present invention, various known color fading preventing agents can be employed. Typical examples of organic color fading preventing agents include hindered phenols (for example, hydroquinones, 6-hydroxychromans, 5-hydroxycoumarians, spirochromans, p-alkoxyphenols, bisphenols, etc.), gallic acid derivatives, methylenedioxybenzenes, aminophenols, hindered amines, or ether or ester derivatives thereof derived from each of these compounds by sililation or alkylation of the phenolic hydroxy group thereof. Further, metal complexes represented by (bissalicylaldoxymato) nickel complexes and (bis-N,N-dialkyldithiocarbamato) nickel complexes may be employed as color fading preventing agents.

For the purpose of preventing degradation of yellow dye images due to heat, humidity and light, compounds having both a hindered amine partial structure and a hindered phenol partial structure in the molecule, as described in U.S. Pat. No. 4,268,593, provide good results. For the purpose of preventing degradation of magenta dye images, particularly degradation due to light, spiroindanes as described in Japanese Patent Application (OPI) No. 159644/81 and chromans substituted with a hydroquinone diether or monoether, as described in Japanese Patent Application (OPI) No. 89835/80, provide preferred results.

In order to improve preservability, particularly light fastness of cyan dye images, it is preferred to also employ a benzotriazole type ultraviolet ray absorbing agent. Such an ultraviolet ray absorbing agent may be emulsified together with a cyan coupler. The coating amount of the ultraviolet ray absorbing agent is selected so as to sufficiently improve the light stability of cyan dye images. When the amount of the ultraviolet ray absorbing agent employed is too large, however, undesirable yellow coloration may occur in unexposed areas (white background areas) of color photographic materials containing them. Therefore, the amount is usually preferred to be in a range from about $1\times10^{-4}$ mol/m$^2$ to about $2\times10^{-3}$ mol/m$^2$ and particularly from $5\times10^{-4}$ mol/m$^2$ to $1.5\times10^{-3}$ mol/m$^2$.

In color paper having a conventional light-sensitive layer structure, the ultraviolet ray absorbing agent is incorporated into one of two layers adjacent to a red-sensitive emulsion layer containing a cyan coupler, and preferably incorporated into both adjacent layers thereof. When the ultraviolet ray absorbing agent is incorporated into an intermediate layer positioned between a green-sensitive emulsion layer and a red-sensitive emulsion layer, it may be emulsified together with a color mixing preventing agent. In the case of adding the ultraviolet ray absorbing agent to a protective layer, another protective layer may be separately provided thereon as an outermost layer. A matting agent having an appropriate particle size, etc. can be incorporated into the outermost protective layer.

The color photographic light-sensitive material used in the present invention may further contain an ultraviolet ray absorbing agent in a hydrophilic colloid layer.

The color photographic light-sensitive material used in the present invention may contain water-soluble dyes as filter dyes, for irradiation prevention, halation prevention or other various purposes, in a hydrophilic colloid layer.

The color photographic light-sensitive material used in the present invention may contain in photographic emulsion layers or other hydrophilic colloid layers a brightening agent of the stilbene series, triazine series, oxazole series, or coumarin series, etc. Water-insoluble brightening agents may be used in the form of a dispersion.

The present invention can be applied to a multilayer, multicolor photographic light-sensitive material having at least two differently spectrally sensitized silver halide photographic emulsion layers, each having a different spectral sensitivity, on a support, as described above. The multilayer natural color photographic light-sensitive material usually has at least one red-sensitive silver halide emulsion layer, at least one green-sensitive silver halide emulsion layer, and at least one blue-sensitive silver halide emulsion layer on a support. The order of the disposition of these emulsion layers on the support can be suitably selected, depending on the desired properties and practical usage of the material.

Further, each of the above-described emulsion layers may be composed of two or more emulsion layers having different sensitivities. Moreover, between two or more emulsion layers sensitive to the same spectral wave-length range, a light-insensitive layer may be present.

In the color photographic light-sensitive material according to the present invention, it is preferred to provide a subsidiary layer, such as a protective layer, intermediate layer, a filter layer, an antihalation layer, a back layer, etc., in appropriate positions in addition to the silver halide emulsion layer.

Suitable binders or protective colloids for the photographic emulsion layers or intermediate layers of the color photographic light-sensitive material according to the present invention include gelatin, which is advantageous for purposes of the present invention but other hydrophilic colloids can also be used.

For example, proteins such as gelatin derivatives, graft polymers of gelatin and other polymers, albumin, casein, etc.; saccharide derivatives, such as cellulose derivatives, for example, hydroxyethyl cellulose, carboxymethyl cellulose, cellulose sulfate, etc., sodium alginate, starch derivatives, etc.; and various synthetic hydrophilic high molecular weight substances such as hompolymers or copolymers of, for example, polyvinyl alcohol, polyvinyl alcohol semiacetal, poly-N-vinylpyrrolidone, polyacrylic acid, polymethacrylic acid, polyacrylamide, polyvinylimidazole, polyvinylpyrazole, etc.

As used herein gelatin includes not only lime-processed gelatin, but also acid-processed gelatin and enzyme-processed gelatin as described in *Bull. Soc. Sci. Phot. Japan,* No. 16, page 30 (1966). Further, hydrolyzed products of gelatin or enzymatically decomposed products of gelatin can also be used.

Moreover, various kinds of stabilizers, contamination preventing agents, developing agents or precursors thereof, development accelerating agents or precursors thereof, lubricants, mordants, matting agents, antistatic agents, plasticizers or other additives useful for photographic light-sensitive materials can be incorporated into the color photographic light-sensitive material according to the present invention, in addition to the above-described additives. Typical examples of these additives are described in *Research Disclosure,* No. 17643 (December, 1978) and *Research Disclosure,* No. 18716 (November, 1979).

The term "reflective support" suitably employed in the present invention means a support having an increased reflection property for the purpose of rendering dye images formed in the silver halide emulsion layer more clear. Examples of the reflective support include a support having coated thereon hydrophobic resin containing a light reflective substance such as titanium oxide, zinc oxide, calcium carbonate, calcium sulfate, etc. dispersed therein, and a support composed of a hydrophobic resin containing a light reflective substance dispersed therein. More specifically, suitable supports include baryta coated paper, polyethylene coated paper, polypropylene type synthetic paper, transparent supports, for example, a glass plate, a polyester film such as a polyethylene terephthalate film, a cellulose triacetate film, a cellulose nitrate film, etc., a polyamide film, a polycarbonte film, a polystyrene film, etc. having a reflective layer or having a reflective substance incorporated therein. A suitable support can be appropriately selected depending on the purpose for which the photographic material is to be used.

Processing steps (image forming steps) which are applied to the photographic light-sensitive materials of the present invention will be described in detail below.

In the present invention, the processing time for the color development step can be short (i.e., not more than about 2 minutes and 30 seconds, and it can be further shortened to the range of from 10 seconds to 2 minutes. The term "processing time for the color development step" as used herein means the period of the time beginning with the time when the photographic light-sensitive material comes into contact with the color developing solution to the time when the photographic material comes into contact with the subsequent processing solution and therefore, it includes the transfer time between the processing baths.

Primary aromatic amine color developing agents which can be used in the color developing solution according to the present invention include known compounds which are widely employed in various color photographic developing processes. These developing agents include aminophenol derivatives and p-phenylenediamine derivatives. Preferred examples are p-phenylenediamine derivatives. Typical examples of the p-phenylenediamine derivatives which may be used are set forth below, but the present invention should not be construed as being limited thereto:

D-1 N,N-Diethyl-p-phenylenediamine
D-2 2-Amino-5-diethylaminotoluene
D-3 2-Amino-5-(N-ethyl-N-laurylamino)toluene
D-4 4{N-Ethyl-N-(β-hydroxyethyl)amino}aniline
D-5 2-Methyl-4-{N-ethyl-N-(β-hydroxyethyl-)amino}aniline
D-6 N-Ethyl-N-(β-methanesulfonamidoethyl)-3-methyl-4-aminoaniline
D-7 N-(2-Amino-5-diethylaminophenylethyl)methanesulfonamide
D-8 N,N-Dimethyl-p-phenylenediamine
D-9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethylaniline These p-phenylenediamine derivatives may be in the form of salts such as sulfates, hydrochlorides, sulfites, p-toluenesulfonates, etc. The above-described compounds are described in U.S. Pat. Nos. 2,193,015, 2,552,241, 2,566,271, 2,592,364, 3,656,950 and 3,698,525, etc. The aromatic primary amine developing agent is used in an amount of from about 0.1 g to about 20 g, and preferably from about 0.5 g to about 10 g, per liter of a developing solution.

The color developing solution used in the present invention may also contain hydroxylamines, as is well known.

While hydroxylamines can be employed in the form of a free amine in the color developing solution, they are more preferably used in the form of a water-soluble acid salt. Examples of such salts include a sulfate, an oxalate, a hydrochloride, a phosphate, a carbonate, an acetate, etc. Hydroxylamines may be substituted or unsubstituted. Further, the nitrogen atom in hydroxylamines may be substituted with an alkyl group.

The amount of hydroxylamine added is preferably from 0 to about 10 g, and more preferably from 0 to 5 g per liter of the color developing solution. It is desirable that the amount of the hydroxylamine be reduced if the stability of the color developing solution can be maintained.

Also, the color developing solution used in the present invention may preferably contain sulfites such as sodium sulfite, potassium sulfite, sodium bisulfite, potassium bisulfite, sodium metasulfite, potassium metasulfite, etc., or carbonyl-sulfite adducts, as preservatives. The amount of these compounds added is preferably from 0 to about 20 g, and more preferably from 0 to 5 g per liter of the color developing solution. It is preferred to add these compounds in a lesser amount if the stability of the color developing solution can be maintained.

Examples of other preservatives which may be added to the color developing solution include aromatic polyhydroxy compounds as described in Japanese Patent Application (OPI) Nos. 49828/77, 47038/81, 32140/81 and 160142/84, U.S. Pat. No. 3,746,544, etc.; hydroxyacetones as described in U.S. Pat. No. 3,615,503, British Pat. No. 1,306,176, etc.; α-aminocarbonyl compounds as described in Japanese Patent Application (OPI) Nos. 143020/77 and 89425/78, etc.; various metals as described in Japanese Patent Application (OPI) Nos. 44148/82 and 53749/82, etc.; various saccharides as described in Japanese Patent Application (OPI) No. 102727/77, etc.; hydroxamic acids as described in Japanese Patent Application (OPI) No. 27638/77, etc.; α,α'-dicarbonyl compounds as described in Japanese Patent Application (OPI) No. 160141/84, etc.; salicylic acids as described in Japanese Patent Application (OPI) No. 180588/84, etc.; alkanolamines as described in Japanese Patent Application (OPI) No. 3532/79, etc,; poly(alkyleneimines) as described in Japanese Patent Application (OPI) No. 94349/81, etc.; gluconic acid derivatives as described in Japanese Patent Application (OPI) No. 75647/81, etc.; and the like.

Two or more kinds of such preservatives may be employed together, if desired.

Paticularly, it is preferred to add 4,5-dihydroxy-m-benzenedisulfonic acid, poly(ethyleneimine), and triethanolamine, etc. Further, it is preferred to add substituted phenols such as p-nitrophenol, etc.

The color developing solution used in the present invention has a pH which preferably ranges from about 9 to about 12, and more preferably from 9 to 11.0. The color developing solution may also contain any compounds known as components of developing solutions.

In order to maintain the pH within the above described range, various kinds of buffers are preferably employed. Examples of such buffers include carbonates, phosphates, borates, tetraborates, hydroxybenzoates, glycine salts, N,N-dimethylglycine salts, leucine salts, norleucine salts, guanine salts, 3,4-dihydroxylphenylalanine salts, alanine salts, aminobutyrates, 2-amino-2-methyl-1,3-propanediol salts, valine salts, proline salts, trishydroxyaminomethane salts, lysine salts, etc. Particularly, carbonates, phosphates, tetraborates and hydroxybenzoates are preferably employed, since they have certain advantages, i.e., they have good solubility and excellent buffering function in a high pH range such as pH of 9.0 or higher, they do not give rise to adverse effects (such as fog formation) on photographic characteristics when added to the color developing solution, and they are inexpensive.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, the present invention should not be construed as being limited to these compounds.

The amount of the buffers to be added to the color developing solution is preferably about 0.1 mol or more, and more preferably from 0.1 mol to 0.4 mol per liter thereof.

In addition, various chelating agents can be used in the color developing solution according to the present invention for the purpose of preventing calcium or magnesium precipitation or increasing the stability of the color developing solution.

Suitable chelating agents preferably include organic acid compounds, for example, aminopolycarboxylic acids as described in Japanese Patent Publication Nos. 30496/73 and 30232/69, etc.; organic phosphonic acids as described in Japanese Patent Application (OPI) No. 97347/81, Japanese Patent Publication No. 39359/81, West German Pat. No. 2,227,639, etc.; phosphonocarboxylic acids as described in Japanese Patent Application (OPI) Nos. 102726/77, 42730/78, 121127/79, 126241/80 and 65956/80, etc.; compounds as described in Japanese Patent Application (OPI) Nos. 195845/83 and 203440/83, Japanese Patent Publication No. 40900/78, etc.

Specific examples of these chelating agents are set forth below, but the present invention should not be construed as being limited thereto:

Nitrilotriacetic acid
Diethyleneaminopentaacetic acid
Ethylenediaminetetraacetic acid
Triethylenetetraminehexaacetic acid
N,N,N-trimethylenephosphonic acid
Ethylenediamine-N,N,N',N'-tetramethylenephosphonic acid
1,3-Diamino-2-propanoltetraacetic acid
trans-Cyclohexanediaminetetraacetic acid
Nitrilotripropionic acid
1,2-Diaminopropanetetraacetic acid
Hydroxyethyliminodiacetic acid
Glycol ether diaminetetraacetic acid
Hydroxyethylenediaminetriacetic acid
Ethylenediamine o-hydroxyphenylacetic acid
2-Phosphonobutane-1,2,4-tricarboxylic acid
1-Hydroxyethane-1,1-diphosphonic acid
N,N'-Bis(2-hydroxybenzyl)ethylenediamine-N,N'-diacetic acid Two or more kinds of such chelating agents may be employed together, if desired. The chelating agent is added to the color developing solution in an amount sufficient to block metal ions present therein. For example, a range from about 0.1 g to about 10 g per liter of color developing solution is suitably employed.

The color developing solution may also contain appropriate development accelerators, if desired.

Examples of suitable development accelerators include thioether type compounds as described in Japanese Patent Publication Nos. 16088/62, 5987/62, 7826/63, 12380/69 and 9019/70, U.S. Pat No. 3,813,247, etc.; p-phenylenediamine type compounds as described in Japanese Patent Application (OPI) Nos. 49829/77 and 15554/75, etc.; quaternary ammonium salts as described in Japanese Patent Application (OPI) Nos. 137726/75, 156826/81 and 43429/77, Japanese Patent Publication No. 30074/69, etc.; p-aminophenols as described in U.S. Pat. Nos. 2,610,122 and 4,119,462, etc.; amine type compounds as described in U.S. Pat. Nos. 2,494,903, 3,128,182, 4,230,796, 3,253,919, 2,482,546, 2,596,926 and 3,582,346, Japanese Patent Publication No. 11431/66, etc.; polyalkylene oxides as described in Japanese Patent Publication Nos. 16088/62, 25201/67, 11431/66 and 23883/67, U.S. Pat. Nos. 3,128,183 and 3,532,501, etc.; 1-phenyl-3-pyrazolidones; hydrazines, mesoionic compounds; thione type compounds; imidazoles; etc. Of these compounds, thioether type compounds and 1-phenyl-3-pyrazolidones are preferred.

The color developing solution used in the present invention may contain suitable antifoggants, if desired. Alkali metal halides such as potassium bromide, sodium chloride and potassium iodide, etc. as well as organic antifoggants, may be employed as antifoggants. Examples of organic antifoggants include nitrogen-containing heterocyclic compounds such as benzotriazole, 6-nitrobenzimidazole, 5-nitroindazole, 5-methylbenzotriazole, 5-nitrobenzotriazole, 5-chlorobenzotriazole, 2-thiazolylbenzimidazole, 2-thiazolylmethylbenzimidazole and hydroxyazaindolizine, etc.; mercapto-substituted heterocyclic compounds such as 2-mercaptobenzimidazole and 2-mercaptobenzothiazole, etc.; adenine; and mercapto-substituted aromatic compounds such as thiosalicylic acid; etc. These antifoggants may accumulate in the color developing solution as a result of their dissolution from the color photographic light-sensitive material being processed, and it is preferred that the amount of accumulation thereof it small from the standpoint of a reduction in the amount of discharge.

It is preferred that the color developing solution according to the present invention contains fluorescent brightening agents. Preferred fluorescent brightening agents are 4,4'-diamino-2,2'-disulfostilbene type compounds. The amount of the fluorescent brightening agents added is form 0 to about 5 g, and preferably from 0.1 g to 2 g, per liter of the color developing solution.

Furthermore, the color developing solution according to the present invention may contain various surface active agents such as alkylphosphonic acids, arylphosphonic acids, aliphatic carboxylic acids, aromatic carboxylic acids, etc., if desired.

The processing temperature of the color development step used in the present invention is preferably from about 30° C. to about 50° C., and more preferably from 33° C. to 42° C. Further, the amount of replenisher for the color developing solution is from about 30 ml to about 2,000 ml, and preferably from 30 ml to 1,500 ml, per square meter of the color photographic light-sensitive material being processed. It is preferred that the amount of the replenisher is small in view of a reduction in the amount of discharge.

The ferric complex salt of an organic acid which is used as a bleaching agent in the bleach-fixing solution employed in the present invention is preferably a complex of a ferric ion and a chelating agent such as an aminopolycarboxylic acid, a salt thereof, an aminopolyphosphonic acid or a salt thereof, a phosphonocarboxylic acid etc. Salts of aminopolycarboxylic acids or aminopolyphosphonic acids are salts of an aminopolycarboxylic acid or an aminopolyphosphonic acid with an alkali metal, ammonium or a water-soluble amine. Examples of the alkali metal include sodium, potassium, lithium, etc. Examples of the water-soluble amine include alkylamines such as methylamine, diethylamine, triethylamine, butylamine, etc.; alicyclic amines such as cyclohexylamine, etc.; arylamines such as aniline, m-toluidine, etc.; and heterocyclic amines such as pyridine, morpholine, piperidine, etc.

Typical examples of the chelating agents (such as aminopolycarboxylic acids, aminopolyphosphonic acids or salts thereof) are set forth below, but the present invention should not be construed as being limited thereto:

Ethylenediaminetetraacetic acid;
Disodium ethylenediaminetetraacetate;
Diammonium ethylenediaminetetraacetate;
Tetra(trimethylammonium) ethylenediaminetetraacetate;
Tetrapotassium ethylenediaminetetraacetate;
Tetrasodium ethylenediaminetetraacetate;
Trisodium ethylenediaminetetraacetate;
Diethylenetriaminepentaacetic acid;
Pentasodium diethylenetriaminepentaacetate;
Ethylenediamine-N-(β-oxyethyl)-N,N',N'-triacetic acid;
Trisodium ethylenediamine-N-(β-oxyethyl)-N,N',N'-triacetate;
Triammonium ethylenediamine-N-(β-oxyethyl)-N,N',N'-triacetate;
1,3-Diaminopropanetetraacetic acid;
Disodium 1,3-diaminopropanetetraacetate;
Nitrilotriacetic acid;
Trisodium nitrilotriacetate;
Cyclohexanediaminetetraacetic acid;
Disodium cyclohexanediaminetetraacetate;
Iminodiacetic acid;
Dihydroxyethyloglycine;
Ethyl ether diaminetetraacetic acid;
Glycol ether diaminetetraacetic acid;
Ethylenediaminetetrapropionic acid;
Phenylenediaminetetraacetic acid
1,3-Diaminopropanol-N,N,N',N'-tetramethylenephosphonic acid
Ethylenediamine-N,N,N',N'-tetramethylenephosphonic acid
1,3-Diaminopropane-N,N,N',N'-tetramethylenephosphonic acid The ferric complex salts of an organic acid may be used in the form of a complex salt per se or may be formed in situ in solution by using a ferric salt (e.g., ferric sulfate, ferric chloride, ferric nitrate, ferric ammonium sulfate or ferric phosphate, etc.) and a chelating agent (e.g., an aminopolycarboxylic acid, an aminopolyphosphonic acid or a phosphonocarboxylic acid, etc.). When they are used in the form of a complex salt, they may be used alone or as a combination of two or more. On the other hand, where a complex is formed in situ in solution by using a ferric salt and a chelating agent, one, two or more ferric salts may be used. Further, one, two or more chelating agents may also be used. In each of these situations, a chelating agent may be used in an excess amount of that necessary for forming a ferric ion complex salt.

Of the ferric ion complexes, ferric complexes of aminopolycarboxylic acids are preferred. The amount of the ferric ion complex in the bleach-fixing solution is from about 0.01 mol to about 1.0 mol, and preferably from 0.05 mol to 0.50 mol, per liter of the solution.

In the bleach-fixing solution, a bleach accelerating agent can be used, if desired. Specific examples of suitable bleach accelerating agents include compounds having a mercapto group or a disulfide group as described in U.S. Pat. No. 3,893,858, West German Pat. Nos. 1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78, and 28426/78, *Research Disclosure, No.* 17129 (July, 1978), etc.; thiazolidine dirivatives as described in Japanese Patent Application (OPI) No. 140129/75, etc.; thiourea derivatives as described in Japanese Patent Publication No. 8506/70, Japanese Patent Application (OPI) Nos. 20832/77 and 32735/78, U.S. Pat. No. 3,706,561, etc.; iodides as described in West German Pat. No. 1,127,715, Japanese Patent Application (OPI) No. 16235/83, etc.; polyethyleneoxides as described in West German Pat. Nos. 966,410 and 2,748,430, etc.; polyamine compounds as described in Japanese Patent Publication No. 8836/70, etc.; compounds as described in Japanese Patent Application (OPI) Nos. 42434/74, 59644/74, 94927/78, 35727/79, 26506/80 and 163940/83; etc. Of these compounds, compounds having a mercapto group or a disulfide group are preferred in view of their excellent bleach accelerating effects. Particularly, the compounds as described in U.S. Pat. No. 3,893,858, West German Pat. No. 1,290,812 and Japanese Patent Application (OPI) No. 95630/78 are preferred.

The bleach-fixing solution used in the present invention can contain chloride salts, one or more kinds of inorganic acids, organic acids, alkali metal salts thereof or ammonium salts thereof which have a pH buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.), corrosion preventing agents (e.g., ammonium nitrate, guanidine, etc.), or the like may be added, if desired.

Suitable fixing agents which can be employed in the bleach-fixing solution include known fixing agents, that is, water-soluble silver halide solvents such as thiosulfates (e.g., sodium thiosulfate, ammonium thiosulfate, etc.); thiocyanates (e.g., sodium thiocyanate, ammonium thiocyanate, etc.); thioether compounds (e.g., ethylenebisthioglycolic acid, 3,6-dithia-1,8-octanediol, etc.); and thioureas which may be used individually or as a combination of two or more. In addition, a special bleach-fixing solution comprising a combination of a fixing agent and a large amount of a halide compound such as potassium iodide, as described in Japanese Patent Application (OPI) No. 155354/80, can be used as well. In the present invention, a thiosulfate, particularly ammonium thiosulfate, is preferably employed.

The amount of the fixing agent used in the bleach-fixing solution is preferably from about 0.3 mol to about 2 mol, and more preferably from 0.5 mol to 1.0 mol, per liter of the solution.

The pH of the bleach-fixing solution used in the present invention is preferably from about 3 to about 10, and more preferably from 4 to 9. When the pH of the bleach-fixing solution is outside of this range, the desilvering property is increased but there is a tendency for degradation of the solution to occur and the formation of leuco dyes of cyan dyes to be accelerated. On the contrary, when the pH is higher than this value, decreased desilvering ability and increase in stain are apt to occur.

In order to adjust pH, the bleach-fixing solution may contain, if desired, hydrochloric acid, sulfuric acid, nitric acid, acetic acid (glacial acetic acid), a bicarbonate, ammonia, potassium hydroxide, sodium hydroxide, sodium carbonate, potassium carbonate, etc. Further, various kinds of fluorescent brightening agents, defoaming agents and surface active agents, polyvinyl pyrrolidone, organic solvents (e.g., methanol, etc.), etc. may be incorporated into the bleach-fixing solution, as desired.

The bleach-fixing solution used in the present invention may further contain, as preservatives, compounds capable of releasing sulfite ions, such as sulfites (e.g., sodium sulfite, potassium sulfite, ammonium sulfite, etc.), bisulfites (e.g., ammonium bisulfite, sodium bisulfite, potassium bisulfite etc.), metabisulfites (e.g., potassium metabisulfite, sodium metabisulfite, ammonium metabisulfite, etc.), etc. The amount of such compounds added is preferably from about 0.02 mol to about 0.50 mol, and more preferably from 0.04 mol to 0.40 mol, per liter of the solution (calculated in terms of sulfite ion).

While it is common to add sulfites as preservatives, other compounds such as ascorbic acid, a carbonyl-bisulfic acid adduct, and a carbonyl compound, etc. may be added for this purpose.

Further, buffers, fluorescent brightening agents, chelating agents, and antimold agents, etc. may be added, if desired.

The bleach-fixing step of the present invention is generally followed by a water washing step which will be described below.

According to the present invention, a simplified processing method, for example, a method wherein only a so-called "stabilizing step" is conducted, without carrying out a substantial water washing step, can be employed in place of a conventional "water washing step" (which includes rinse washing). The term "water washing step" as used in the present invention refers to the the broader meaning as described above.

It is difficult to specify the precise amount of washing water used in the present invention, since it can vary depending on the number of baths employed in a multistage countercurrent water washing process and the amount of the preceding bath components carried over with the photographic light-sensitive material. However, it is sufficient for purposes of the present invention that the amount of the bleach-fixing solution components is not more than about $5\times10^{-2}$ liter, preferably not more than $1\times10^{-2}$ liter in one liter of the final water washing bath. For example, in the case of a countercurrent water washing process using three tanks, the amount of water used is preferably about 1,000 ml or more, and more preferably about 5,000 ml or more, per square meter of the photographic light-sensitive material being processed. Further, it is preferred to use from 100 ml to 1,000 ml per square meter of the photographic light-sensitive material in the case of a water-saving process.

The temperature of the water washing step is in a range from about 15° C. to about 45° C., and preferably from 20° C. to 35° C.

The pH of the water washing or stabilizing bath is from about 4 to about 10, preferably from 5 to 9, and more preferably from 6.5 to 8.5.

It is preferred to employ water which has been subjected to water softening treatment as the washing water or a stabilizing solution. The water softening treatment can be carried out by a method using an ion exchange resin or a reverse permeation device.

As an ion exchange resin, a sodium type strong acidic cationic exchange resin, in which a counter ion of an exchange group is a sodium ion, is preferred. Further, an $H^+$ type strong acidic cationic exchange resin and an ammonium type strong acidic cationic exchange resin can also be employed. Moreover, it is preferred to employ an $H^+$ type strong acidic cationic exchange resin together with an $OH^-$ type anionic exchange resin. As a resin substratum, a copolymer of styrene, divinylbenzene, etc. is preferred. Particularly, a copolymer in which an amount of divinylbenzene is from 4 to 16% by weight based on the total amount of monomers in the preparation is preferred. Suitable examples of these ion exchange resins include Diaion SK-1B, Diaion PK-216 (trade name, manufactured by Mitsubishi Chemical Industries Ltd.), etc.

Various reverse permeation devices can be employed. A device using a cellulose acetate or polyethersulfone film is suitably used. A device having a pressure of about 20 kg/cm$^2$ or less is preferably used because of its low noise.

Using water having a reduced amount of calcium or magnesium treated with an ion exchange resin or a reverse permeation device as described above, the propagation of bacteria or molds can be controlled. Thus, preferred results can be obtained in this manner.

According to a preferred emobiment of the present invention, at least one of an aminocarboxylic acid, an aminophosphonic acid, a phosphonic acid, a phosphonocarboxylic acid or a salt of any of these acids is added to the washing water or the stabilizing solution in an amount of from about $5\times10^{-4}$ to about $1\times10^{-2}$ mol per liter of the water or solution.

In the water washing step used in the present invention, various known compounds may be employed for the purpose of preventing the formation of precipitation or stabilizing the washing water, if desired. Examples of such additives include a chelating agent such as an inorganic phosphoric acid, an aminopolycarboxylic acid, an organic phosphonic acid, etc.; a germicidal agent or an anti-fungal agent for preventing the propagation of various bacteria, algae and molds (e.g., the compounds as described in *J. Antibact. Antifung. Agents,* Vol. 11, No. 5, pages 207 to 223 (1983) or the compounds as described in Hiroshi Horiguchi, *Boukin Boubai No Kagaku,* 1st edition, pages 20 to 277 (1982); a metal salt, such as a magnesium salt or an aluminum salt, etc.; an alkali metal or ammonium salt; or a surface active agent for reducing the drying load or preventing drying marks; or the like. Further, the compounds as described in L. E. West, *Photo. Sci. and enc.,* Vol. 6, pages 344 to 359 (1965) may be added thereto.

Further, the present invention is particularly effective in the case wherein the water washing step is carried out by a multi-stage countercurrent water washing process using two or more tanks containing washing water to which a chelating agent, a germicidal agent or an anti-fungal agent is added for the purpose of remarkably reducing the amount of washing water. Moreover, the present invention is also particularly effective in the case wherein a multistage countercurrent stabilizing step (a so-called stabilizing process) as described in Japanese Patent Application (OPI) No. 8543/82 is conducted, in place of a conventional water washing step.

Various kinds of compounds may be added to the stabilizing bath for the purpose of stabilizing images formed. Representative examples of such compounds include various buffers (for example, borates, metaborates, borax, phosphates, carbonates, potassium hydroxide, sodium hydroxide, aqueous ammonia, monocarboxylic acids, dicarboxylic acids, polycarboxylic acids, etc. which may be used in combination) in order to adjust the pH of layers (to for example, a pH of 3 to 8), and aldehydes such as formalin, etc. In addition, various additives, for example, a chelating agent (e.g., an inorganic phosphonic acid, an aminopolycarboxylic acid, an organic phosphonic acid, an aminopolyphosphonic acid, a phosphonocarboxylic acid, etc.), a germicidal agent (e.g., those of thiazole type, isothiazole type, halogenated phenol type, sulfanylamido type, benzotriazole type, etc.), a surface active agent, a fluorescent brightening agent, a hardening agent, etc. may be employed. Two or more compounds used for the same purpose or for different purposes may be employed together.

Further, it is preferred to add various ammonium salts such as ammonium chloride, ammonium nitrate, ammonium sulfate, ammonium phosphate, ammonium sulfite, ammonium thiosulfate, etc., as pH adjusting agents for layers after development processing, in order to improve image preservability.

In the case wherein the amount of washing water is largely reduced as described above, it is preferred that a part or all of the overflow from the washing water is introduced into the bleach-fixing bath which is the bath preceding the washing water, for the purpose of reducing the amount of discharge.

Moreover, in the case of continuous processing according to the present invention, variations of the composition of each processing solution can be prevented using a replenisher of each processing solution, whereby a constant finish can be achieved. The amount of the replenisher can be reduced to one half or less of the standard amount of replenisher for the purpose of reducing cost, etc.

In each of the processing baths, a heater, a temperature sensor, a liquid level sensor, a circulation pump, a filter, a floating cover, a squeezer, a nitrogen gas stirrer, an air stirrer, etc. may be provided, if desired.

The method according to the present invention can be applied to any type of processing, as long as a color developing solution is employed therein. For example, it can be utilized in the processing of color paper, color reversal paper, color positive films, color negative films, color reversal films, etc. Particularly, it is highly effective for the processing of color paper and color reversal paper.

The present invention is explained in greater detail with reference to the following examples, but the present invention should not be construed as being limited thereto. Unless otherwise indicated, all parts, percents, ratios and the like are by weight.

EXAMPLE 1

Silver Halide Emulstion (1) was prepared in the following manner.

| | |
|---|---|
| Solution 1 | |
| $H_2O$ | 1,000 ml |
| NaCl | 5.5 g |
| Gelatin | 32 g |
| Solution 2 | |
| Sulfuric acid (1N) | 20 ml |
| Solution 3 | |
| A compound (1 wt %) of the formula: | 3 ml |

-continued

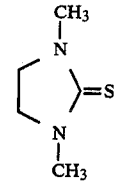

| | |
|---|---|
| Solution 4 | |
| KBr | 2.80 g |
| NaCl | 0.34 g |
| $H_2O$ to make | 140 ml |
| Solution 5 | |
| $AgNO_3$ | 5 g |
| $H_2O$ to make | 140 ml |
| Solution 6 | |
| KBr | 67.24 g |
| NaCl | 8.26 g |
| $K_2IrCl_6$ (0.001 wt %) | 0.7 ml |
| $H_2O$ to make | 320 ml |
| Solution 7 | |
| $AgNO_3$ | 120 g |
| $H_2O$ to make | 320 ml |

Solution 1 was heated at 75° C., Solution 2 and Solution 3 were added thereto and, then, Solution 4 and Solution 5 were added thereto simultaneously over a period of 9 minutes. After 10 minutes, Solution 6 and Solution 7 were added simultaneously over a period of 45 minutes. After 5 minutes, the temperature was lowered, and the mixture was desalted. Water and gelatin for dispersion were added thereto, and the pH was adjusted to 6.2, whereby a monodispersed cubic silver chlorobromide emulsion having an average grain size of 1.01 μm, a coefficient of variation (a value obtained by dividing the standard deviation by an average grain size: s/d) of 0.08, and a silver bromide content of 80 mol% was obtained. The emulsion was subjected to optimum chemical sensitization using sodium thiosulfate.

Further, Silver Halide Emulsion (2) was prepared in the following manner.

| | |
|---|---|
| Solution 8 | |
| $H_2O$ | 1,000 ml |
| NaCl | 5.5 g |
| Gelatin | 32 g |
| Solution 9 | |
| Sulfuric acid (IN) | 24 ml |
| Solution 10 | |
| A compound (1 wt %) of the formula: | 3 ml |

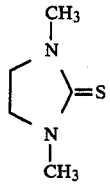

| | |
|---|---|
| Solution 11 | |
| KBr | 17.92 g |
| NaCl | 2.20 g |
| $H_2O$ to make | 220 ml |
| Solution 12 | |
| $AgNO_3$ | 32 g |
| $H_2O$ to make | 200 ml |
| Solution 13 | |
| KBr | 71.68 g |
| NaCl | 8.81 g |

-continued

| | |
|---|---|
| $K_2IrCl_6$ (0.001 wt %) | 4.5 ml |
| $H_2O$ to make | 600 ml |
| Solution 14 | |
| $AgNO_3$ | 128 g |
| $H_2O$ to make | 600 ml |

Solution 8 was heated at 56° C., solution 9 and Solution 10 were added thereto and, then, Solution 11 and Solution 12 were added thereto simultaneously over a period of 30 minutes. After 10 minutes, Solution 13 and Solution 14 were added simultaneously over a period of 20 minutes. After 5 minutes, the temperature was lowered, and the mixture was desalted. Water and gelatin for dispersing were added thereto, and the pH was adjusted to 6.2, whereby a monodispersed cubic silver chlorobromide emulsion having an average grain size of 0.45 μm, a coefficient of variation of 0.08, and a silver bromide content of 80 mol% was obtained. The emulsion was subjected to optimum chemical sensitization using sodium thiosulfate.

Furthermore, preparation of a series of silver halide emulsions having a low silver bromide content was carried out. More specifically, silver chlorobromide emulsions and silver chloride emulsions each having a silver bromide content of 30, 20, 1 or 0 mol%, which were designated Silver Halide Emulsions (3) to (10), respectively, were prepared in the same manner as described for Silver Halide Emulsions (1) or (2), except for changing the time for the addition of the solution and the amounts of KBr and NaCl.

The average grain size, coefficient of variation, and halogen composition of each of Silver Halide Emulsions (1) to (10) thus obtained are shown in Table 1 below.

TABLE 1

| Emulsion | AgBr:AgCl (ml %) | Average Grain Size (μm) | Coefficient of Variation | Layer used |
|---|---|---|---|---|
| (1) | 80:20 | 1.01 | 0.08 | Blue-sensitive layer |
| (2) | 80:20 | 0.45 | 0.08 | Green-sensitive layer and Red-sensitive layer |
| (3) | 30:70 | 1.05 | 0.07 | Blue-sensitive layer |
| (4) | 30:70 | 0.46 | 0.08 | Green-sensitive layer and Red-sensitive layer |
| (5) | 20:80 | 1.01 | 0.08 | Blue-sensitive layer |
| (6) | 20:80 | 0.46 | 0.07 | Green-sensitive layer and Red-sensitive layer |
| (7) | 1:99 | 1.00 | 0.08 | Blue-sensitive layer |
| (8) | 1:99 | 0.45 | 0.07 | Green-sensitive layer and Red-sensitive layer |
| (9) | 0:100 | 1.03 | 0.07 | Blue-sensitive layer |
| (10) | 0:100 | 0.46 | 0.07 | Green-sensitive layer and Red-sensitive layer |

On a paper support, both surfaces of which were laminated with polyethylene, layers were coated as shown in Table 2 below in order to prepare a color printing paper. The coating solution of the first layer was prepared in the following manner.

Preparation of Coating Solution for First Layer 10 g of Yellow Coupler (a) and 23 g of Color Image Stabilizer (a) were dissolved in a mixture of 10 ml of ethyl acetate and 4 ml of a mixture of Solvents (b) and (c), and the resulting solution was dispersed and emulsified in 90 ml of a 10% aqueous solution of gelatin containing 5 ml of a 10% aqueous solution of sodium dodecylbenzenesulfonate. Separately, to Silver Halide Emulsion (1) (containing 70 g of silver per Kg of the emulsion) was added $7\times10^{-4}$ mols of Sensitizing Dye I shown below per mol of silver halide to prepare a blue-sensitive emulsion. The above-described emulsified dispersion was mixed with the blue-sensitive silver chlorobromide emulsion, with the concentration of the resulting mixture being controlled with gelatin so as to form the composition shown in Table 2 below, whereby the coating solution for the first layer was prepared.

Coating solutions for the second layer to the seventh layer were prepared in a similar manner as described for the coating solution for the first layer. The composition of each layer is shown in Table 2 below.

The following sensitizing dyes were employed in preparation of the color printing paper.

Sensitizing Dye I for Blue-Sensitive Emulsion Layer

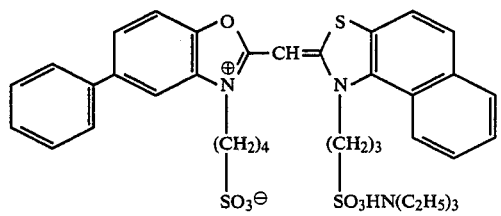

(Amount added: $7\times10^{-4}$ mol per mol of silver halide)

Sensitizing Dye II for Green-Sensitive Emulsion Layer

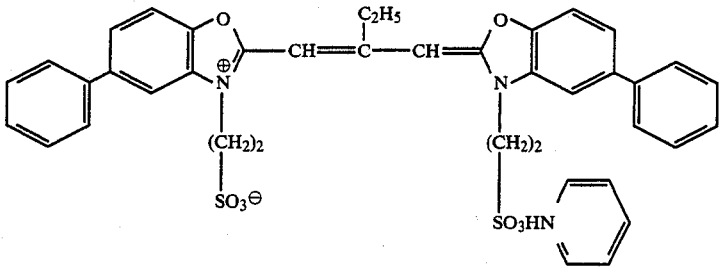

(Amount added: $4\times10^{-4}$ mol per mol of silver halide)

Sensitizing Dye III for Red-Sensitive Emulsion Layer

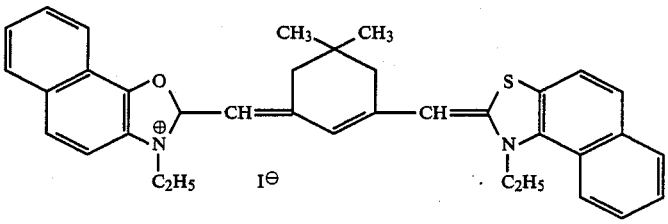

(Amount added: $2\times10^{-4}$ mol per mol of silver halide)

The following dyes were also employed as irradiation preventing dyes in preparation of the color printing paper.

Irradiation Preventing Dye I for Green-Sensitive Emulsion Layer

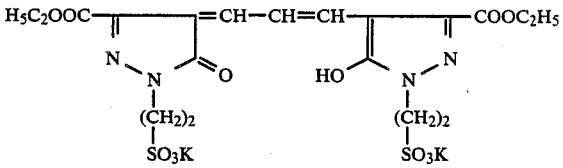

(Amount added: $2.1\times10^{-5}$ mol/m$^2$)

Irradiation Preventing Dye II for Red-Sensitive Emulsion Layer

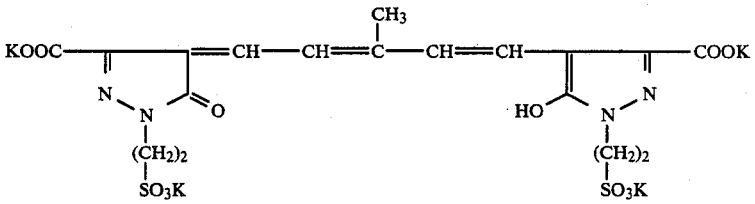

(Amount added: $2.0\times10^{-5}$ mol/m$^2$)

In addition, structural formulae of the compounds such as couplers used in this example are shown below:

Yellow Coupler (a):

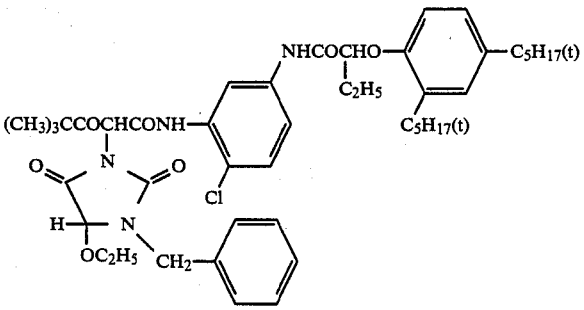

-continued
Yellow Coupler (b):
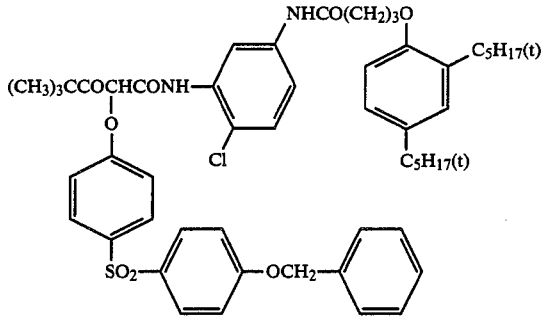
Magenta Coupler (a):
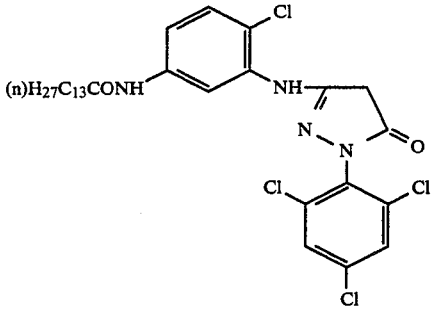
Magenta Coupler (b):
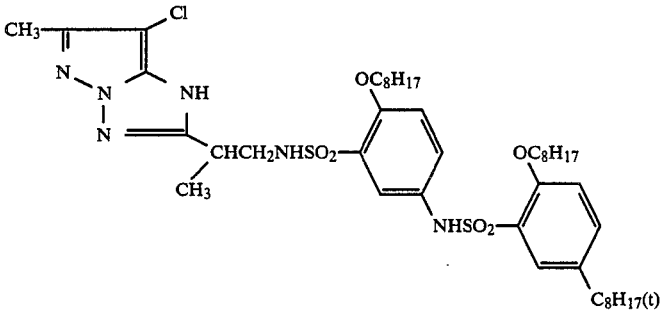
Magenta Coupler (c):
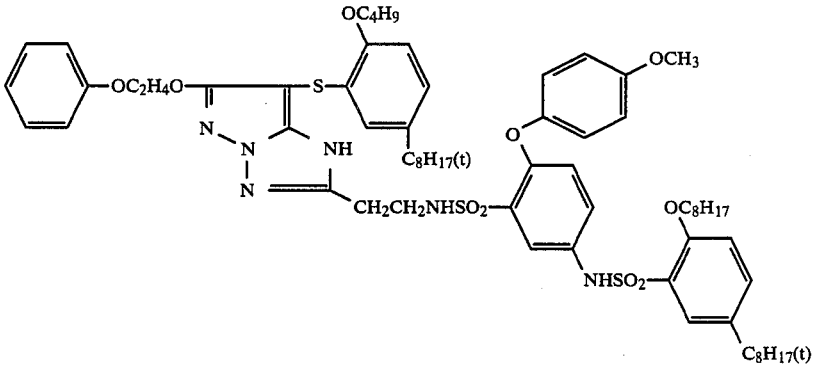
Magenta Coupler (d):
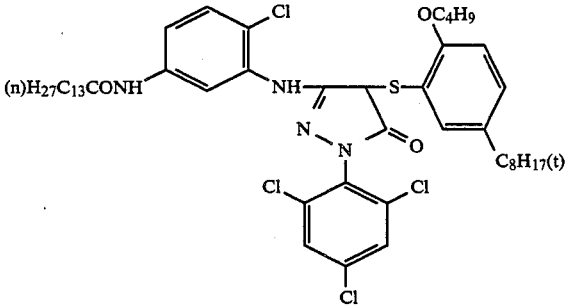

-continued
Cyan Coupler (a):
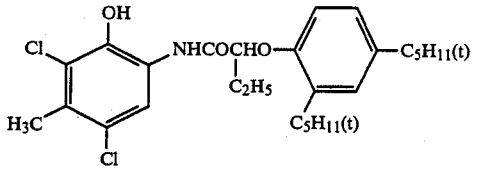
Cyan Coupler (b):
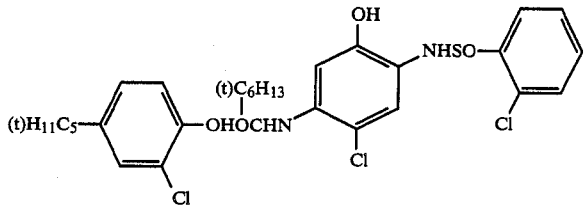
Cyan Coupler (c):
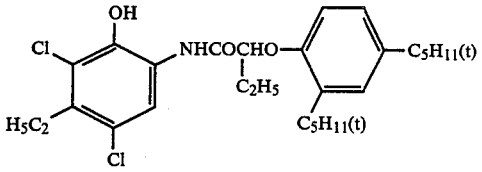
Color Image Stabilizer (a):
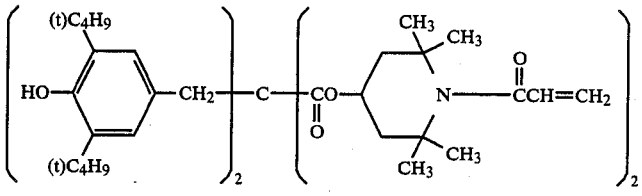
Color Image Stabilizer (b):
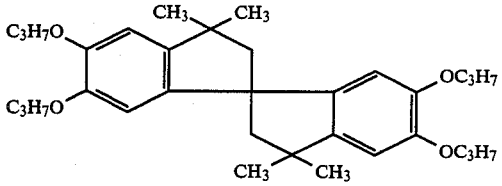
Color Image Stabilizer (c):
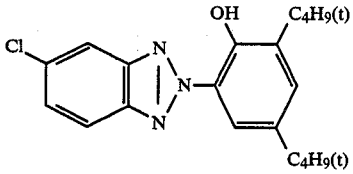
Ultraviolet Light Absorbing Agent (a):
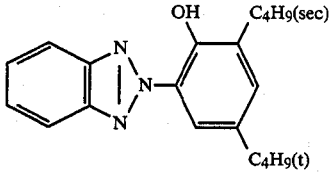
Ultraviolet Light Absorbing Agent (b):
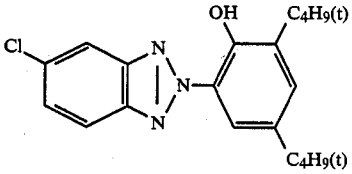

-continued

Ultraviolet Light Absorbing Agent (c):

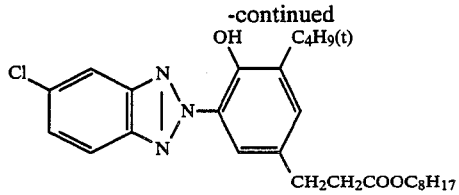

Color Mixing Preventing Agent (a):

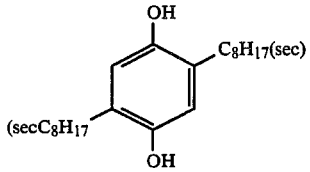

Color Mixing Preventing Agent (b):

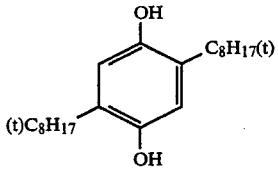

Solvent (a):

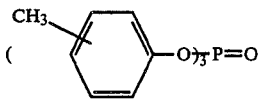

Solvent (b):

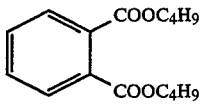

Solvent (c): $(C_9H_{19}O)_3P{=}O$

Solvent (d): $(C_8H_{17}O)_3P{=}O$

TABLE 2

| Layer | Composition | Amount Used |
|---|---|---|
| Seventh Layer (Protective layer) | Gelatin | 1.33 g/m$^2$ |
| | Acryl-modified Polyvinyl Alcohol Copolymer (degree of modification: 17%) | 0.17 g/m$^2$ |
| Sixth Layer (Ultraviolet light absorbing layer) | Gelatin | 0.54 g/m$^2$ |
| | Ultraviolet Light Absorbing Agent (mixture of (a), (b) and (c) in a molar ratio of 1:5:3) | $5.10 \times 10^{-4}$ mol/m$^2$ |
| | Solvent (b) | 0.08 g/m$^2$ |
| Fifth Layer (Red-sensitive layer) | Silver Halide Emulsion (2) | 0.02 g/m$^2$ (as silver) |
| | Sensitizing Dye III | $2 \times 10^{-4}$ mol/mol AgX |
| | Irradiation Preventing Dye II | $2.0 \times 10^{-5}$ mol/m$^2$ |
| | Gelatin | 0.90 g/m$^2$ |
| | Cyan Coupler (mixture of (a) and (b) in a molar ratio of 1:1 | $7.05 \times 10^{-4}$ mol/m$^2$ |
| | Color Image Stabilizer (mixture of (c), (d) and (a) in a weight ratio of 1:3:3) | $5.20 \times 10^{-4}$ mol/m$^2$ |
| | Solvent (a) | 0.22 g/m$^2$ |
| Fourth Layer (Ultraviolet light absorbing layer) | Gelatin | 1.60 g/m$^2$ |
| | Ultraviolet Light Absorbing Agent (mixture of (a), (b) and (c) in a molar ratio of 1:5:3) | $1.70 \times 10^{-4}$ mol/m$^2$ |
| | Color Mixing Preventing Agent (b) | $1.60 \times 10^{-4}$ mol/m$^2$ |
| | Solvent (b) | 0.24 g/m$^2$ |
| Third Layer (Green-sensitive layer) | Silver Halide Emulsion (2) | 0.30 g/m$^2$ (as silver) |
| | Sensitizing Dye II | $4 \times 10^{-4}$ mol/mol AgX |
| | Irradiation Preventing Dye I | $2.1 \times 10^{-5}$ mol/m$^2$ |
| | Geratin | 1.56 g/m$^2$ |
| | Magenta Coupler (a) | $3.38 \times 10^{-4}$ mol/m$^2$ |
| | Color Image Stabilizer (b) | 0.19 g/m$^2$ |
| | Solvent (mixture of (a) and (d) in a molar ratio of 1:1 | 0.59 g/m$^2$ |
| Second Layer (Color mixing preventing layer) | Gelatin | 0.90 g/m$^2$ |
| | Color Mixing Preventing Agent (a) | $2.33 \times 10^{-4}$ mol/m$^2$ |
| First Layer (Blue-sensitive layer) | Silver Halide Emulsion (1) | 0.35 g/m$^2$ (as silver) |
| | Sensitizing Dye I | $7 \times 10^{-4}$ mol/mol AgX |
| | Gelatin | 1.35 g/m$^2$ |
| | Yellow Coupler (a) | $6.91 \times 10^{-4}$ mol/m$^2$ |
| | Color Image Stabilizer (a) | 0.13 g/m$^2$ |

TABLE 2-continued

| Layer | Composition | Amount Used |
|---|---|---|
| | Solvent (mixture of (b) and (c) in a molar ratio 1:1) | 0.02 g/m$^2$ |
| Support | Polyethylene laminated paper (the polyethylene coating containing a white pigment ($TiO_2$) and a bluish dye (ultramarine) on the first layer side) | — |

The coating solutions for the first layer to the seventh layer were coated on the paper support, both surfaces of which were laminated with polyethylene, whereby Sample 101 was prepared.

Further, Samples 102 to 112 were prepared in the same manner as described for Sample 101, except for changing the compositions as shown in Table 3 below.

TABLE 3

| Sample No. | Silver Halide Emulsion: Blue-Sensitive Layer | Silver Halide Emulsion: Green-Sensitive Layer | Silver Halide Emulsion: Red-Sensitive Layer | Yellow Coupler for Blue-Sensitive Layer | Magenta Coupler for Green-Sensitive Layer | Cyan Coupler for Red-Sensitive Layer |
|---|---|---|---|---|---|---|
| 101 | (1) | (2) | (2) | (a) | (a) | (a) + (b)* |
| 102 | (3) | (4) | (4) | (a) | (a) | (a) + (b)* |
| 103 | (5) | (6) | (6) | (a) | (a) | (a) + (b)* |
| 104 | (7) | (8) | (8) | (a) | (a) | (a) + (b)* |
| 105 | (9) | (10) | (10) | (a) | (a) | (a) + (b)* |
| 106 | (7) | (8) | (8) | (a) | (b)*** | (a) + (b)* |
| 107 | (7) | (8) | (8) | (a) | (c)*** | (a) + (b)* |
| 108 | (7) | (8) | (8) | (a) | (d)*** | (a) + (b)* |
| 109 | (7) | (8) | (8) | (a) | (a) | (c) |
| 110 | (7) | (8) | (8) | (a) | (a) | (a) |
| 111 | (7) | (8) | (8) | (a) | (a) | (a) + PMMA** |
| 112 | (7) | (8) | (8) | (b) | (a) | (a) + (b)* |

*(a) + (b) indicates a blend of (a) and (b) in a molar ratio of 1:1.
**PMMA indicates polymethyl methacrylate having an average molecular weight of about 15,000 which was used as an emulsified dispersion together with the coupler in an amount of 1.5 times of the weight of the coupler.
***When Magenta Coupler (b), (c) or (d) was employed, the coating amount of silver was reduced by 50%

Samples 101 to 105 thus prepared were exposed through a blue filter using a light source of 3,200° K. in an exposure amount so as to prepare samples having a yellow density of 2.0 and gray colored samples having yellow, magenta and cyan densities of 2.0 respectively. The thus-exposed samples were subjected to processing according to the following processing steps.

| Processing Steps | Temperature (°C.) | Time (sec) |
|---|---|---|
| Color Development | 35 | 45 |
| Bleach-Fixing | 35 | 45 |
| Rinse 1 | 33 | 20 |
| Rinse 2 | 33 | 20 |
| Rinse 3 | 33 | 20 |
| Drying | 70 | 50 |

The composition of each processing solution was as follows.

| Color Developing Solution | |
|---|---|
| Disodium ethylenediaminetetraacetate dihydrate | 2.0 g |
| Triethanolamine | 8.0 g |
| N,N—Diethylhydroxylamine | 4.2 g |
| Sodium sulfite | 0.1 g |
| Potassium carbonate | 25 g |
| Sodium chloride | 1.5 g |
| 4-Amino-3-methyl-N—ethyl-N—{β-(methanesulfonamido)ethyl}-p-phenylenediamine sulfate | 5.0 g |
| Fluorescent whitening agent (4,4'-diaminostilbene type) | 3.0 g |

-continued

| | |
|---|---|
| Water to make | 1,000 ml pH 10.05 |
| **Bleach-Fixing Solution** | |
| Ammonium Fe(III) ethylenediamine-tetraacetate monohydrate | 55 g |
| Disodium ethylenediaminetetraacetate dihydrate | 10 g |
| Ammonium thiosulfate (70 g/l solution) | 100 ml |
| Sodium sulfite | 17 g |
| Ammonium bromide | Shown in Tables 4-(1) and 4-(2) |
| Water to make | 1,000 ml pH 6.00 |

Rinse Solutions 1, 2 and 3

Desalted water was employed.

The term "desalted water" as used herein means water prepared by treating conventional city water using a cation exchange resin Diaion SK-1B (trade name, manufactured by Mitsubishi Chemical Industries Ltd.) so as to make calcium and magnesium concentration 5 mg or less per liter according to the method as described in Japanese patent application No. 131632/86.

With the yellow colored samples thus obtained, yellow, magenta and cyan densities were measured, and color reproducibility of yellow was determined. Further, with the gray colored samples thus obtained, the amount of remaining silver was measured by an X-ray fluorometric analysis method. The results thus obtained are shown in Tables 4-(1) and 4-(2).

TABLE 4

| Sample No. | 0.0* | 0.005* | 0.01* | 0.5* | 1.0* | 2.0* | 2.5* |
|---|---|---|---|---|---|---|---|
| | Magenta Density in Yellow Colored Sample (D = 2.0) | | | | | | |
| 101 | 0.34 | 0.34 | 0.34 | 0.33 | 0.35 | 0.38 | 0.83 |
| 102 | 0.35 | 0.35 | 0.34 | 0.32 | 0.37 | 0.39 | 0.82 |
| 103 | 0.38 | 0.35 | 0.29** | 0.27** | 0.25** | 0.32** | 0.88 |
| 104 | 0.39 | 0.36 | 0.28** | 0.26** | 0.23** | 0.33** | 0.85 |

TABLE 4-continued

| Sample No. | 0.0* | 0.005* | 0.01* | 0.5* | 1.0* | 2.0* | 2.5* |
|---|---|---|---|---|---|---|---|
| 105 | 0.40 | 0.36 | 0.28** | 0.26** | 0.22** | 0.33** | 0.87 |
| | Amount of Remaining Silver in Gray Colored Sample (μg/cm²) | | | | | | |
| 101 | 4.5 | 4.5 | 4.5 | 4.2 | 5.0 | 5.8 | 53.5 |
| 102 | 5.5 | 5.5 | 5.0 | 4.0 | 6.3 | 6.7 | 54.4 |
| 103 | 6.2 | 5.8 | 3.5** | 2.5** | 2.0** | 4.0** | 58.2 |
| 104 | 6.5 | 6.1 | 3.4** | 2.3** | 1.5** | 4.2** | 56.4 |
| 105 | 7.0 | 6.0 | 3.0** | 2.3** | 1.4** | 4.2** | 57.7 |

*Concentration of Ammonium Bromide in Bleach-Fixing Solution (mol/l)
**Present Invention From the results shown in Table 4-(1) and 4-(2), it is apparent that when the coated samples (Samples 103 to 105) composed of silver chloride or silver chlorobromide containing at least 80 mol% of silver chloride according to the present invention were processed with the bleach-fixing solution containing ammonium bromide in the concentration range according to the present invention, the amount of remaining silver was small in the gray colored samples, and relatively low magenta color densities in the yellow colored samples were obtained, which resulted in excellent colored reproduction. On the contrary, in the case of processing with the bleach-fixing solution having an ammonium bromide concentration of 2.5 mol per liter, very poor desilvering occurred.

EXAMPLE 2

Samples 101 to 112 prepared in Example 1 were imagewise exposed in the same manner as described in Example 1 and processed in the same manner as described in Example 1, except for using an ammonium bromide concentration of $5\times10^{-1}$ mol in the bleach-fixing solution. The results thus-obtained are shown in Table 5.

TABLE 5

| Sample No. | Remark | Optical Density in Yellow Colored Sample: Yellow | Magenta | Cyan | Amount of Remaining Silver in Gray Colored Sample (μg/cm²) |
|---|---|---|---|---|---|
| 101 | Comparison | 2.0 | 0.33 | 0.20 | 4.2 |
| 102 | Comparison | 2.0 | 0.32 | 0.20 | 4.0 |
| 103 | Present Invention | 2.0 | 0.27 | 0.15 | 2.5 |
| 104 | Present Invention | 2.0 | 0.26 | 0.15 | 2.3 |
| 105 | Present Invention | 2.0 | 0.26 | 0.15 | 2.3 |
| 106 | Present Invention | 2.0 | 0.26 | 0.15 | 2.2 |
| 107 | Present Invention | 2.0 | 0.26 | 0.14 | 2.1 |
| 108 | Present Invention | 2.0 | 0.26 | 0.15 | 2.4 |
| 109 | Present Invention | 2.0 | 0.24 | 0.13 | 1.5 |
| 110 | Present Invention | 2.0 | 0.26 | 0.14 | 2.0 |
| 111 | Present Invention | 2.0 | 0.23 | 0.13 | 1.0 |
| 112 | Present Invention | 2.0 | 0.24 | 0.13 | 1.2 |

From the results shown in Table 5, it is apparent that when the photographic light-sensitive materials according to the present invention were processed with the bleach-fixing solution according to the present invention (i.e., Sample Nos. 103 to 112), the amount of remaining silver was small, and the resulting color images exhibited excellent color reproduction in yellow as compared with the comparative examples. Particularly, in Samples 109, 111 and 112, the amount of remaining silver was very small.

EXAMPLE 3

The same procedure as described in Example 2 was conducted, except for using a color developing solution having the following composition:

| Color Developing Solution B | |
|---|---|
| Benzyl alcohol | 15 ml |
| Diethylene glycol | 10 ml |
| Disodium ethylenediaminetetraacetate dihydrate | 2.0 g |
| Triethanolamine | 8.0 g |
| N,N—Diethylhydroxylamine | 4.2 g |
| Sodium sulfite | 0.1 g |
| Potassium carbonate | 25 g |
| Sodium chloride | 1.5 g |
| 4-Amino-3-methyl-N—ethyl-N—[β-(methanesulfonamido)ethyl]-p-phenylenediamine sulfate | 5.0 g |
| Fluorescent whitening agent (4,4'-diaminostilbene type) | 3.0 g |
| Water to make | 1,000 ml pH 10.05 |

The color developing solution used in Example 2 was designated Color Developing Solution A. The results thus obtained are shown in Table 6.

TABLE 6

| Sample No. | Remarks | Color Developing Solution A*: Optical Density in Yellow Colored Sample: Yellow | Magenta | Cyan | Amount of Remaining Silver in Gray Colored Sample (μg/cm²) | Color Developing Solution B: Optical Density in Yellow Colored Sample: Yellow | Magenta | Cyan | Amount of Remaining Silver in Gray Colored Sample (μg/cm²) |
|---|---|---|---|---|---|---|---|---|---|
| 101 | Comparison | 2.0 | 0.33 | 0.20 | 4.2 | 2.0 | 0.37 | 0.24 | 4.4 |
| 102 | Comparison | 2.0 | 0.32 | 0.20 | 4.0 | 2.0 | 0.36 | 0.23 | 4.1 |
| 103 | Present Invention | 2.0 | 0.27 | 0.15 | 2.5 | 2.0 | 0.30 | 0.20 | 3.0 |
| 104 | Present Invention | 2.0 | 0.26 | 0.15 | 2.3 | 2.0 | 0.29 | 0.20 | 2.8 |
| 105 | Present Invention | 2.0 | 0.26 | 0.15 | 2.3 | 2.0 | 0.28 | 0.19 | 2.7 |
| 106 | Present Invention | 2.0 | 0.26 | 0.15 | 2.2 | 2.0 | 0.28 | 0.19 | 2.7 |
| 107 | Present | 2.0 | 0.26 | 0.14 | 2.1 | 2.0 | 0.28 | 0.18 | 2.5 |

TABLE 6-continued

| Sample No. | Remarks | Color Developing Solution A* Optical Density in Yellow Colored Sample Yellow | Magenta | Cyan | Amount of Remaining Silver in Gray Colored Sample ($\mu g/cm^2$) | Color Developing Solution B Optical Density in Yellow Colored Sample Yellow | Magenta | Cyan | Amount of Remaining Silver in Gray Colored Sample ($\mu g/cm^2$) |
|---|---|---|---|---|---|---|---|---|---|
| 108 | Invention Present Invention | 2.0 | 0.26 | 0.15 | 2.4 | 2.0 | 0.30 | 0.21 | 3.0 |
| 109 | Present Invention | 2.0 | 0.24 | 0.13 | 1.5 | 2.0 | 0.27 | 0.17 | 2.0 |
| 110 | Present Invention | 2.0 | 0.26 | 0.14 | 2.0 | 2.0 | 0.29 | 0.20 | 2.7 |
| 111 | Present Invention | 2.0 | 0.23 | 0.13 | 1.0 | 2.0 | 0.25 | 0.15 | 1.8 |
| 112 | Present Invention | 2.0 | 0.24 | 0.13 | 1.2 | 2.0 | 0.28 | 0.18 | 2.5 |

*Data of Table 5 obtained in Example 2.

EXAMPLE 4

The same procedures as described in Examples 2 and 3 was conducted with respect to Samples 101 to 108 except for using a bleach-fixing solution and rinse solutions 1, 2 and 3 each having the following compositions.

| | |
|---|---|
| Bleach-Fixing Solution | |
| Ammonium Fe(III) cyclohexanediaminetetraacetate | 60 g |
| Cyclohexanediaminetetraacetic acid monohydrate | 9 g |
| Ammonium thiosulfate (700 g/l solution) | 100 ml |
| Sodium Sulfite | 25 g |
| Ammonium bromide | 50 g |
| Water to make | 1,000 ml |
| | pH 7.5 |
| Rinse Solutions 1, 2 and 3 | |
| 1-Hydroxyethylidene-1,1'-diphosphonic acid (60 wt % solu.) | 1.6 ml |
| Bismuth chloride | 0.35 g |
| Polyvinyl pyrrolidone | 0.25 g |
| Trisodium nitrilotriacetate | 1.0 g |
| 5-Chloro-2-methyl-4-isothiazolin-3-one | 50 mg |
| 2-Octyl-4-isothiazolin-3-one | 50 mg |
| Fluorescent whitening agent (4,4'-diaminostilbene type) | 1.0 g |
| Water to make | 1,000 ml |
| | pH 7.50 |

The results thus obtained are shown in Table 7.

TABLE 7

| Sample No. | Remarks | Color Developing Solution A Optical Density in Yellow Colored Sample Yellow | Magenta | Cyan | Amount of Remaining Silver in Gray Colored Sample ($\mu g/cm^2$) | Color Developing Solution B Optical Density in Yellow Colored Sample Yellow | Magenta | Cyan | Amount of Remaining Silver in Gray Colored Sample ($\mu g/cm^2$) |
|---|---|---|---|---|---|---|---|---|---|
| 101 | Comparison | 2.0 | 0.39 | 0.23 | 4.8 | 2.0 | 0.41 | 0.25 | 5.1 |
| 102 | Comparison | 2.0 | 0.37 | 0.22 | 4.5 | 2.0 | 0.40 | 0.24 | 4.9 |
| 103 | Present Invention | 2.0 | 0.31 | 0.17 | 2.8 | 2.0 | 0.34 | 0.20 | 3.2 |
| 104 | Present Invention | 2.0 | 0.30 | 0.17 | 2.6 | 2.0 | 0.33 | 0.21 | 3.1 |
| 105 | Present Invention | 2.0 | 0.29 | 0.18 | 2.3 | 2.0 | 0.36 | 0.20 | 3.0 |
| 106 | Present Invention | 2.0 | 0.28 | 0.17 | 2.0 | 2.0 | 0.35 | 0.19 | 2.4 |
| 107 | Present Invention | 2.0 | 0.30 | 0.15 | 2.4 | 2.0 | 0.32 | 0.18 | 2.8 |
| 108 | Present Invention | 2.0 | 0.27 | 0.15 | 2.1 | 2.0 | 0.33 | 0.17 | 2.3 |

EXAMPLE 5

The same procedure as described in Example 1 was conducted, except for using ammonium iodide in place of ammonium bromide in the bleach-fixing solution. The amounts of ammonium iodide added are set forth in Table 8-(1) and 8-(2). The results thus obtained are shown in Tables 8-(1) and 8-(2).

TABLE 8

| Sample No. | $1 \times 10^{-4}$* | $5 \times 10^{-4}$* | $5 \times 10^{-3}$* | $5 \times 10^{-2}$* | $1 \times 10^{-1}$* |
|---|---|---|---|---|---|
| | Magenta Density in Yellow Colored Sample (D = 2.0) | | | | |
| 101 | 0.34 | 0.34 | 0.34 | 0.37 | 0.84 |
| 102 | 0.35 | 0.35 | 0.34 | 0.39 | 0.92 |
| 103 | 0.37 | 0.32** | 0.31** | 0.33** | 0.93 |
| 104 | 0.38 | 0.31** | 0.29** | 0.32** | 0.95 |
| 105 | 0.37 | 0.31** | 0.28** | 0.32** | 0.90 |
| | Amount of Remaining Silver in Gray Colored Sample ($\mu g/cm^2$) | | | | |
| 101 | 4.5 | 4.5 | 4.3 | 5.1 | 68.3 |
| 102 | 5.5 | 5.0 | 4.5 | 5.8 | 65.7 |
| 103 | 6.0 | 3.8** | 3.2** | 4.2** | 69.4 |
| 104 | 6.2 | 3.6** | 3.0** | 4.0** | 70.2 |
| 105 | 6.5 | 3.5** | 2.8** | 4.0** | 66.3 |

*Concentration of Ammonium iodide in Bleach-Fixing Solution (mol/l)
**Present Invention From the results shown in Tables 8-(1) and 8-(2), it is apparent that excellent photographic images having small amounts of remaining silver were obtained when the photographic light-sensitive materials according to the present invention were processed with bleach-fixing solutions containing ammonium iodide within the range according to the present invention.

EXAMPLE 6

On a paper support, both surfaces of which were laminated with polyethylene and were subjected to corona discharge treatment, a first layer (the lowermost layer) to a seventh layer (the uppermost layer) were coated as shown in Table 9 below to prepare a sample.

The coating solution for the first layer was prepared in the following manner.

A mixture of 200 g of Yellow Coupler (c), 93.3 g of Color Fading Preventing Agent (r), 10 g of Solvent (p) having a high boiling point, 5 g of Solvent (q) having a high boiling point and 600 ml of ethyl acetate as an auxiliary solvent were dissolved by heating at 60° C. The solution was mixed with 3,300 ml of a 5% aqueous solution of gelatin containing 330 ml of a 5% aqueous solution of alkylnapththalenesulfonate (Alkanol B manufactured by du Pont Co.) and emulsified using a colloid mill to prepare a coupler dispersion. From the dispersion ethyl acetate was distilled off under a reduced pressure and then the dispersion was added to 1,400 g of a silver halide emulsion (containing 96.7 g of silver and 170 g of gelatin) containing sensitizing Dye IV for a blue-sensitive emulsion layer and 1-methyl-2-mercapto-5-acetylamino-1,3,4-triazole. Further, 2,600 g of a 10% aqueous solution of gelatin was added thereto to prepare the coating solution.

Coating solution for the second layer to the seventh layer were prepared in a similar manner as described for the coating solution for the first layer, and the composition of each layer is shown in Table 9 below:

TABLE 9

| Layer | Composition | Amount Used |
|---|---|---|
| Seventh Layer (Protective layer) | Gelatin | 600 mg/m$^2$ |
| | Hardening agent (m) | 0.1 g/m$^2$ |
| Sixth Layer (Ultraviolet light absorbing layer) | Ultraviolet light absorbing agent (n) | 260 mg/m$^2$ |
| | Ultraviolet light absorbing agent (o) | 70 mg/m$^2$ |
| | Solvent (p) | 300 mg/m$^2$ |
| | Solvent (q) | 100 mg/m$^2$ |
| | Gelatin | 700 mg/m$^2$ |
| Fifth Layer (Red-sensitive layer) | Silver halide emulsion (shown in Table 10 below) | 210 mg/m$^2$ (as silver) |
| | Sensitizing Dye VI | $2 \times 10^{-4}$ mol/mol AgX |
| | Irradiation Preventing Dye III | $2 \times 10^{-5}$ mol/m$^2$ |
| | Cyan Coupler (d) | 260 mg/m$^2$ |
| | Cyan Coupler (a) | 120 mg/m$^2$ |
| | Color fading preventing agent (r) | 250 mg/m$^2$ |
| | Solvent (p) | 160 mg/m$^2$ |
| | Solvent (q) | 100 mg/m$^2$ |
| | Gelatin | 1,800 mg/m$^2$ |
| Fourth Layer (Color mixing preventing layer) | Color mixing preventing agent (s) | 65 mg/m$^2$ |
| | Ultraviolet light absorbing agent (n) | 450 mg/m$^2$ |
| | Ultraviolet light absorbing agent (o) | 230 mg/m$^2$ |
| | Solvent (p) | 50 mg/m$^2$ |
| | Solvent (q) | 50 mg/m$^2$ |
| | Gelatin | 1,700 mg/m$^2$ |
| Third Layer (Green-sensitive Layer) | Silver halide emulsion (shown in Table 10 below) | 305 mg/m$^2$ (as silver) |
| | Sensitizing Dye V | $4 \times 10^{-4}$ mol/mol AgX |
| | Irradiation Preventing Dye IV | $2 \times 10^{-5}$ mol/m$^2$ |
| | Magenta Coupler (e) | 670 mg/m$^2$ |
| | Color fading preventing agent (t) | 150 mg/m$^2$ |
| | Color fading preventing agent (u) | 10 mg/m$^2$ |
| | Solvent (p) | 200 mg/m$^2$ |
| | Solvent (q) | 10 mg/m$^2$ |
| | Gelatin | 1,400 mg/m$^2$ |
| Second Layer (Color mixing preventing layer) | Silver bromide emulsion (particle size: 0.05 μm) | 10 mg/m$^2$ (as silver) |
| | Color mixing preventing agent (s) | 55 mg/m$^2$ |
| | Solvent (p) | 30 mg/m$^2$ |
| | Solvent (q) | 15 mg/m$^2$ |
| | Gelatin | 800 mg/m$^2$ |
| First Layer (Blue-sensitive layer) | Silver halide emulsion (shown in Table 10 below) | 290 mg/m$^2$ (as silver) |
| | Sensitizing Dye IV | $7 \times 10^{-4}$ mol/mol AgX |
| | Yellow coupler | 600 mg/m$^2$ |
| | Color fading preventing agent (r) | 280 mg/m$^2$ |
| | Solvent (p) | 30 mg/m$^2$ |
| | Solvent (q) | 15 mg/m$^2$ |
| | Gelatin | 1,800 mg/m$^2$ |
| Support | Paper support, both surfaces of which were laminated with polyethylene | — |

The following compounds were used in preparation of the sample.

(m): 1,2-Bis(vinylsulfonyl)-ethane (n): 2-(2-Hydroxy-3,5-di-tert-amylphenyl)benzotriazole (o): 2-(2-Hydroxy-3,5-di-tert-butylphenyl)benzotriazole (p): Di-(2-ethylhexyl)phthalate (q): Dibutyl phthalate (r): 2,5-Di-tert-amylphenyl-3,5-di-tert-butylhydroxybenzoate (s): 2,5-Di-tert-octylhydroquinone (t): 1,4-Di-tert-amyl-2,5-di-octyloxybenzene (u): 2,2'-Methylenebis(4-methyl-6-tert-butylphenol)

Sensitizing Dye IV: Anhydro-5-methoxy-5'-methyl-3,3'-disulfopropylselenacyanine hydroxide Sensitizing Dye V: Anhydro-9-ethyl-5,5'-diphenyl-3,3'-disulfoethyloxacarbocyanine hydroxide Sensitizing Dye VI: 3,3'-Diethyl-5-methoxy-9,9'-(2,2-dimethyl-1,3-propane)thiadicarbocyanine iodide Irradiation Preventing Dye III: 4-(3-Carboxy-5-hydroxy-4-(3-(3-carboxy-5-oxo-1-(4-sulfonatophenyl)-2-pyrazoline-4-ylidene)1-propenyl)-1-pyrazolyl)benzenesulfonate dipotassium salt Irradiation Preventing Dye IV: N,N'-(4,8-Dihydroxy-9,10-dioxy-3,7-disulfonatoanthracene-1,5-diyl)bis-(aminomethanesulfonate) tetrasodium salt.

As a stabilizer for each emulsion layer, 1-methyl-2-mercapto-5-acetylamino-1,3,4-triazole was added in an amount of $1 \times 10^{-5}$ mol per mole of silver halide.

The couplers employed were as follows:

Yellow Coupler (c):

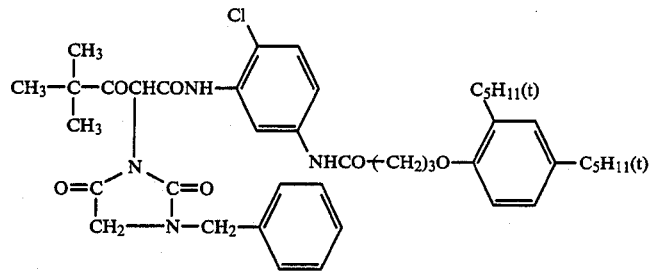

Magenta Coupler (e):

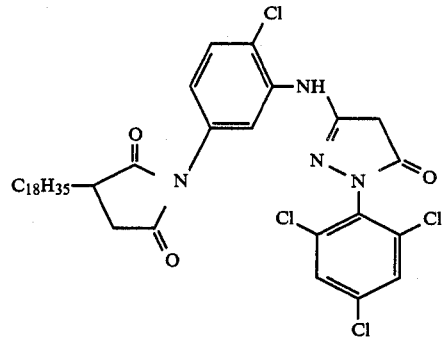

Cyan Coupler (d):

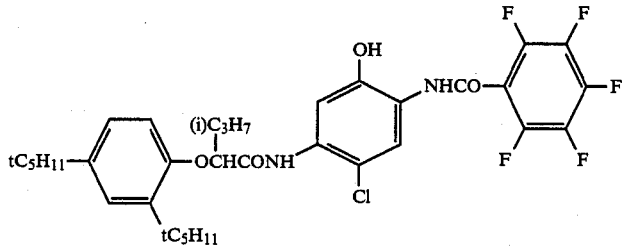

The silver bromide emulsion used in the second layer was prepared in the same manner as in the preparation of Silver Halide Emulsion (1) of Example 1, except that NaCl used in Solutions 1, 4 and 6 was replaced with an equimolar amount of KBr; Solution 3 was not added; and Solution 6 containing no $K_2IrCl_6$ was used.

The other silver halide emulsions described in Table 9 above were prepared as in Example 1, and were then employed in the layers as shown in Table 10 below, whereby Samples 113 to 117 were prepared.

TABLE 10

| Sample No. | Silver Halide Emulsion | | |
|---|---|---|---|
| | Blue-Sensitive Layer | Green-Sensitive Layer | Red-Sensitive Layer |
| 113 | (1) | (2) | (2) |
| 114 | (3) | (4) | (4) |

TABLE 10-continued

| Sample No. | Silver Halide Emulsion | | |
|---|---|---|---|
| | Blue-Sensitive Layer | Green-Sensitive Layer | Red-Sensitive Layer |
| 115 | (5) | (6) | (6) |
| 116 | (7) | (8) | (8) |
| 117 | (9) | (10) | (10) |

Samples 113–117 thus-prepared were processed in the same manner as described in Example 1, using the processing solutions as described in Example 1, except that as the rinse solutions, Rinse Solutions 1, 2 and 3 as described in Example 4 were used, and ammonium bromide and ammonium iodide were added to the bleach-fixing solution in the amounts as shown in Tables 11-(1) and 11-(2) below. The results thus-obtained are shown in Tables 11-(1) and 11-(2).

TABLE 11

| Sample No. | 0.0/0.0* | $0.2/5 \times 10^{-4}$* | $0.5/5 \times 10^{-3}$* | $2.0/5 \times 10^{-2}$* | $2.5/1 \times 10^{-1}$* |
|---|---|---|---|---|---|
| | Magenta Density in Yellow Colored Sample (D = 2.0) | | | | |
| 113 | 0.38 | 0.38 | 0.37 | 0.39 | 0.86 |
| 114 | 0.39 | 0.39 | 0.39 | 0.40 | 0.82 |
| 115 | 0.41 | 0.35** | 0.33** | 0.35** | 0.92 |
| 116 | 0.41 | 0.35** | 0.32** | 0.35** | 0.93 |
| 117 | 0.42 | 0.34** | 0.32** | 0.36** | 0.88 |
| | Amount of Remaining Silver in Gray Colored Sample ($\mu g/cm^2$) | | | | |
| 113 | 4.7 | 4.7 | 4.5 | 5.0 | 70.2 |
| 114 | 5.0 | 4.9 | 5.0 | 5.7 | 68.4 |
| 115 | 6.4 | 3.6** | 3.3** | 4.1** | 71.2 |
| 116 | 6.5 | 3.5** | 3.1** | 4.2** | 72.2 |

TABLE 11-continued

| Sample No. | 0.0/0.0* | 0.2/5 × $10^{-4}$* | 0.5/5 × $10^{-3}$* | 2.0/5 × $10^{-2}$* | 2.5/1 × $10^{-1}$* |
|---|---|---|---|---|---|
| 117 | 6.7 | 3.4** | 2.9** | 4.3** | 69.8 |

*Concentration of Ammonium Bromide/Ammonium Iodide in Bleach-Fixing Solution (mol/l)
**Present Invention From the results shown in Tables 11-(1) and 11-(2), it is apparent that the superior effects of the present invention were also obtained in the case of using both ammonium bromide and ammonium iodide in combination in the bleach-fixing bath as described in Example 1.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising processing an imagewise exposed silver halide color photographic material comprising a support having thereon at least one silver halide emulsion layer comprising silver chloride or silver chlorobromide containing at least about 80 mol% of silver chloride with a color developing solution and thereafter processing said material with a bleach-fixing solution, wherein the bleach-fixing solution contains a ferric complex salt of an organic acid and from about $1\times10^{-2}$ to about 2 mol of bromide ions and/or from $5\times10^{-4}$ to about $5\times10^{-2}$ mol of iodide ions per liter.

2. A method for processing a silver halide color photographic material as claimed in claim 1, wherein the color developing solution contains substantially no benzyl alcohol.

3. A method for processing a silver halide color photographic material as claimed in claim 1, wherein the content of silver chloride in the silver halide emulsion is at least 90 mol%.

4. A method for processing a silver halide color photographic material as claimed in claim 1, wherein the silver halide emulsion substantially excludes silver iodide.

5. A method for processing a silver halide color photographic material as claimed in claim 1, wherein the amount of silver halide coated on the support, calculated in terms of silver, is not more than about 0.78 $g/m^2$.

6. A method for processing a silver halide color photographic material as claimed in claim 1, wherein the silver halide emulsion is a monodispersed silver halide emulsion having a grain size distribution of not more than about 0.2.

7. A method for processing a silver halide color photographic material as claimed in claim 1, wherein the silver halide emulsion is subjected to sulfur sensitization.

8. A method for processing a silver halide color photographic material as claimed in claim 1, wherein the silver halide color photographic material comprises at least one blue-sensitive silver halide emulsion layer containing at least one yellow color forming coupler, at least one green-sensitive silver halide emulsion layer containing at least one magenta color forming coupler, and at least one red-sensitive silver halide emulsion layer containing at least one cyan color forming coupler.

9. A method for processing a silver halide color photographic material as claimed in claim 8, wherein the yellow color forming coupler is selected from acylacetamide type couplers, the magenta color forming coupler is selected from 5-pyrazolone type couplers and pyrazoloazole type couplers, and the cyan color forming coupler is selected from naphthol type couplers and phenol type couplers.

10. A method for processing a silver halide color photographic material as claimed in claim 1, wherein the support is a reflective support.

11. A method for processing a silver halide color photographic material as claimed in claim 1, wherein the color developing solution contains an aromatic primary amine color developing agent.

12. A method for processing a silver halide color photographic material as claimed in claim 1, wherein the time for processing the material with the color developing solution is not more than about 2 minutes and 30 seconds.

13. A method for processing a silver halide color photographic material as claimed in claim 12, wherein said time is from 10 seconds to 2 minutes.

14. A method for processing a silver halide color photographic material as claimed in claim 1, wherein the ferric complex salt of an organic acid is a complex of a ferric ion and a chelating agent, said chelating agent being selected from the group consisting of an aminopolycarboxylic acid, a salt thereof, an aminopolyphosphonic acid and a salt thereof.

15. A method for processing a silver halide color photographic material as claimed in claim 14, wherein the ferric complex salt is a ferric complex of an aminopolycarboxylic acid.

16. A method for processing a silver halide color photographic material as claimed in claim 1, wherein said bleach-fixing solution contains from $1\times10^{-2}$ to $5\times10^{-5}$ mol of bromide ions and/or $5\times10^{-4}$ to $1\times10^{-2}$ mol of iodide ions per liter.

17. A method for processing a silver halide color photographic material as claimed in claim 14, wherein said ferric ion complex is present in said bleach-fixing solution in an amount of from about 0.01 mol to about 1.0 mol per liter.

* * * * *